US008682675B2

(12) United States Patent
Togami et al.

(10) Patent No.: US 8,682,675 B2
(45) Date of Patent: Mar. 25, 2014

(54) SOUND MONITORING SYSTEM FOR SOUND FIELD SELECTION BASED ON STORED MICROPHONE DATA

(75) Inventors: Masahito Togami, Higashiyamato (JP); Yohei Kawaguchi, Hachioji (JP)

(73) Assignee: Hitachi, Ltd., Tokyo (JP)

( * ) Notice: Subject to any disclaimer, the term of this patent is extended or adjusted under 35 U.S.C. 154(b) by 586 days.

(21) Appl. No.: 12/893,114

(22) Filed: Sep. 29, 2010

(65) Prior Publication Data

US 2011/0082690 A1 Apr. 7, 2011

(30) Foreign Application Priority Data

Oct. 7, 2009 (JP) ..... 2009-233525

(51) Int. Cl.
*H04R 1/32* (2006.01)

(52) U.S. Cl.
USPC ..... 704/274; 381/92; 381/313

(58) Field of Classification Search
USPC ..... 704/211, 225, 274; 381/92, 111, 313
See application file for complete search history.

(56) References Cited

U.S. PATENT DOCUMENTS

| | | | | |
|---|---|---|---|---|
| 7,068,797 | B2 * | 6/2006 | Isberg et al. | 381/92 |
| 7,428,309 | B2 * | 9/2008 | Malvar et al. | 381/58 |
| 7,515,721 | B2 * | 4/2009 | Tashev et al. | 381/92 |
| 8,000,482 | B2 * | 8/2011 | Lambert et al. | 381/94.7 |
| 8,009,841 | B2 * | 8/2011 | Christoph | 381/92 |
| 8,098,843 | B2 * | 1/2012 | Kawaguchi et al. | 381/92 |
| 8,189,807 | B2 * | 5/2012 | Cutler | 381/92 |
| 2004/0252845 | A1 * | 12/2004 | Tashev | 381/56 |
| 2005/0058312 | A1 * | 3/2005 | Weidner | 381/313 |
| 2005/0175190 | A1 * | 8/2005 | Tashev et al. | 381/92 |
| 2005/0195988 | A1 * | 9/2005 | Tashev et al. | 381/92 |
| 2005/0246167 | A1 * | 11/2005 | Nakajima et al. | 704/213 |
| 2005/0253713 | A1 | 11/2005 | Yokota | |
| 2007/0172079 | A1 * | 7/2007 | Christoph | 381/92 |
| 2007/0223731 | A1 * | 9/2007 | Togami et al. | 381/92 |
| 2009/0207131 | A1 | 8/2009 | Togami et al. | |
| 2009/0323981 | A1 * | 12/2009 | Cutler | 381/92 |
| 2013/0083944 | A1 * | 4/2013 | Kvist et al. | 381/92 |

FOREIGN PATENT DOCUMENTS

| | | |
|---|---|---|
| JP | 2005-252660 | 9/2005 |
| JP | 2005-328410 | 11/2005 |
| JP | 2009-199158 | 9/2009 |

* cited by examiner

*Primary Examiner* — Martin Lerner
(74) *Attorney, Agent, or Firm* — Antonelli, Terry, Stout & Kraus, LLP.

(57) ABSTRACT

Monitoring accuracy degrades due to a noise where many sound sources exist other than those to be monitored. A sound monitoring system includes a microphone array having multiple microphones and a location-based abnormal sound monitoring section. The location-based abnormal sound monitoring section is supplied with an input signal from the microphone array via a waveform acquisition section and a network. Using the input signal, the location-based abnormal sound monitoring section detects a temporal change in a sound source direction histogram. Based on a detected change result, the location-based abnormal sound monitoring section checks for abnormality in a sound field and outputs a monitoring result. The processing section searches for a microphone array near the sound source to be monitored. The processing section selects a sound field monitoring function for the sound source to be monitored based on various data concerning a microphone belonging to the searched microphone array.

4 Claims, 16 Drawing Sheets

| 1101 MICROPHONE ID | X | Y | Z | 1103 DIRECTIVITY | 1104 A/D CONVERTER | 1105 CHANNEL NUMBER |
|---|---|---|---|---|---|---|
| M1 | 1.0 | 1.04 | 0.0 | OMNIDIRECTIONAL | AD1 | 1 |
| M2 | 1.0 | 1.0 | 0.0 | OMNIDIRECTIONAL | AD1 | 2-10 |
| M3 | 1.0 | 1.0 | 1.0 | SUPERDIRECTIVE | AD2 | 1 |

| 1201 A/D CONVERTER ID | 1202 PC IP ADDRESS | 1203 SYNCHRONIZATION |
|---|---|---|
| AD1 | 192.168.1.1 | SYNCHRONOUS |
| AD2 | 192.168.1.2 | ASYNCHRONOUS |
| AD3 | 192.168.1.3 | SYNCHRONOUS |

SOUND MONITORING SYSTEM FOR SOUND FIELD SELECTION BASED ON STORED MICROPHONE DATA

CLAIM OF PRIORITY

The present application claims priority from Japanese patent application JP2009-233525 filed on Oct. 7, 2009, the content of which is hereby incorporated by reference into this application.

BACKGROUND OF THE INVENTION

The present invention relates to a sound monitoring and speech collection technology that acoustically identifies abnormal operation of an apparatus in a sound monitoring system, more specifically under an environment where multiple apparatuses operate.

There has been conventionally used a monitoring system that monitors abnormal sound of machinery in a factory or abnormalities in a room using camera images or sound information. Such system monitors predetermined monitoring objects only (e.g., see Japanese Patent Application Laid-Open Publication No. 2005-328410).

However, there is an increasing demand for a more comprehensive sound monitoring or speech collection system in accordance with an increase in social needs for safety and security.

BRIEF SUMMARY OF THE INVENTION

The conventional monitoring system monitors a change in the spectral structure of a monitoring object to determine the presence or absence of abnormality. However, a noise degrades the monitoring accuracy in an environment where there are multiple sound sources other than the monitoring object. In addition, there has been a need for a monitoring system capable of easy initialization in a factory or an environment where many machines operate.

It is therefore an object of the present invention to provide a sound monitoring system and a speech collection system capable of acoustically identifying abnormal operation of an apparatus in a factory or an environment where multiple apparatuses operate.

To achieve the above-mentioned object, an aspect of the invention provides a sound monitoring system including: a microphone array having plural microphones; and a processing section. The processing section uses an input signal from the microphone array to detect a temporal change in a histogram of a sound source direction and, based on a detection result, determines whether abnormality occurs in a sound field.

To achieve the above-mentioned object, an aspect of the invention further provides a sound monitoring system including: a microphone array having plural microphones; a processing section; and a storage section. The storage section stores data concerning the microphone. The processing section searches for the microphone array near a sound source to be monitored based on data concerning the microphone and selects a sound field monitoring function for the sound source to be monitored based on data concerning the microphone in the searched microphone array.

To achieve the above-mentioned object, an aspect of the invention moreover provides a speech collection system including: a microphone array having plural microphones; and a processing section. The processing section generates a histogram for each sound source from an input signal for the microphone array and detects orientation of the sound source based on a variation in the generated histogram.

According to an aspect of the invention, a function of detecting a change in a histogram of a sound source direction makes it possible to highly accurately extract an acoustic change in an environment where multiple sound sources exist. A microphone array nearest to each monitoring object is used to automatically select an appropriate sound field monitoring function based on information such as the microphone array directivity and the microphone layout. Sound information can be processed efficiently.

A configuration according to an aspect of the invention can provide a maintenance monitoring system capable of monitoring in an environment where multiple sound sources exist. A sound field monitoring function can be automatically selected at a large-scale factory, improving the work efficiency.

DETAILED DESCRIPTION OF THE INVENTION

Embodiments of the present invention will be described in further detail with reference to the accompanying drawings. In this specification, "a means" may be referred to as "a function", "a section", or "a program". For example, "a sound field monitoring means" may be represented as "a sound field monitoring function", "a sound field monitoring section", or "a sound field monitoring program".

First Embodiment

Figure 1:
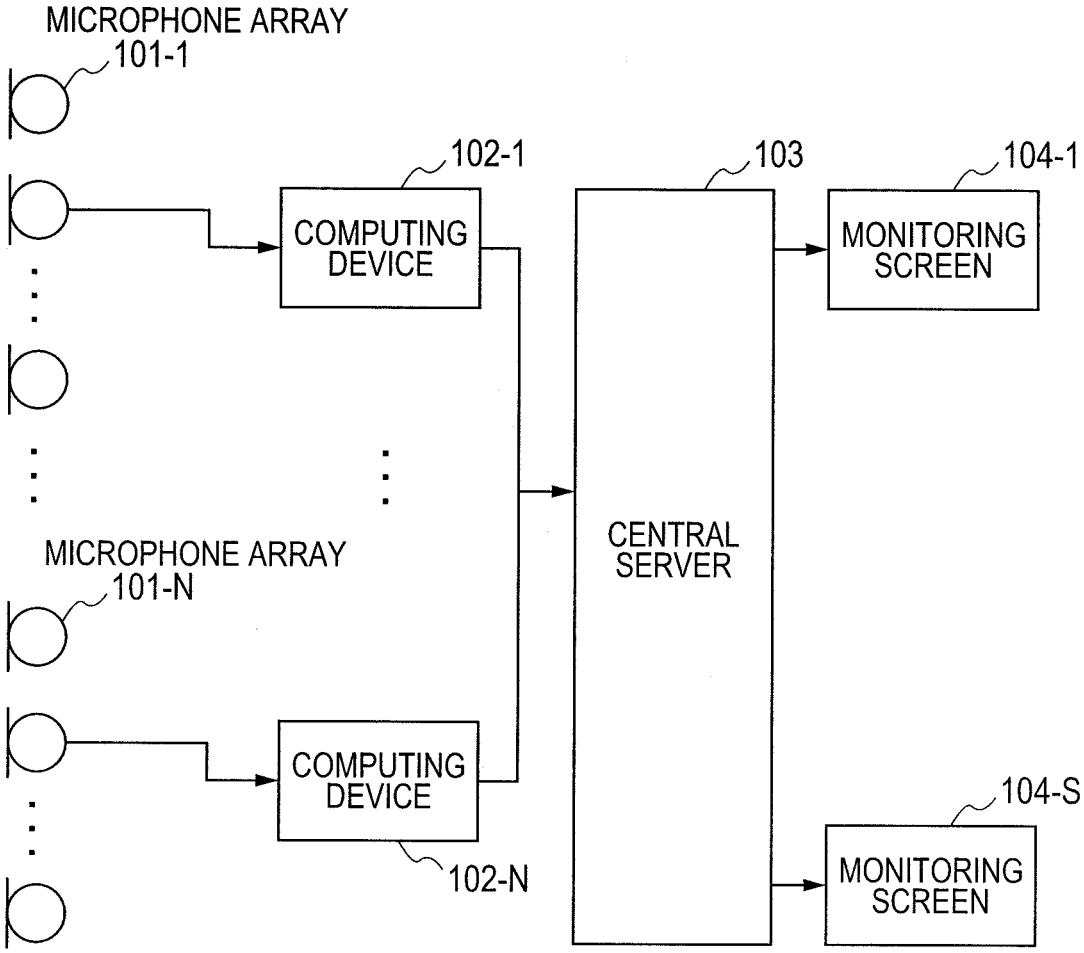
FIG. 1 shows an overall hardware configuration of a sound monitoring system according to a first embodiment.

FIG. 1 shows an overall configuration of a maintenance and monitoring system according to the first embodiment. An input section includes microphone arrays 101-1 through 101-N having N microphone elements embedded in an environment such as a factory. The input section is supplied with an input signal used as sound information. Computing devices 102-1 through 102-N as signal processing sections apply digital signal processing to the sound information and extract abnormality information. The extracted abnormality information is transmitted to a central server 103. The central server 103 synthetically processes (abnormality information extraction) the abnormality information extracted by the microphone arrays 101-1 through 101-N and then transmits the information to monitoring screens 104-1 through 104-S (S is equivalent to the number of monitoring screens) as display sections viewed by operators. The microphone arrays 101-1 through 101-N at locations acquire analog sound pressure values. The computing devices 102-1 through 102-N convert the analog sound pressure values into digital signals and apply digital signal processing to the digitals signals.

Figure 2:
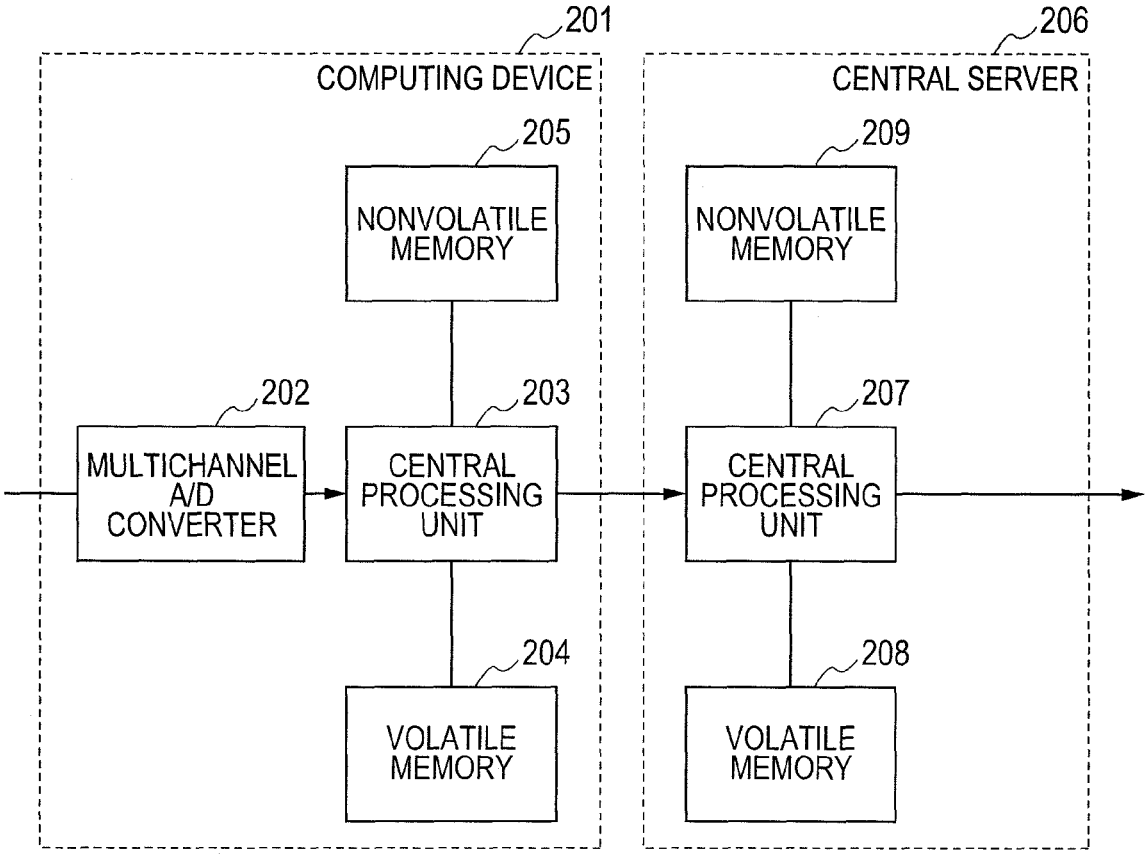
FIG. 2 shows a hardware configuration for each location of the system according to the first embodiment.

FIG. 2 shows specific hardware configurations 201 and 206 for the computing devices 102-1 through 102-N and the central server 103. Basically, each of the configurations is equivalent to that of an ordinary computer including the central processing unit (CPU) as a processing section and memory as a storage section. In each computing device 201, a multichannel A/D converter 202 converts analog sound pressure values supplied from channels into a multichannel digital speech waveform. A central processing unit 203 transmits the converted digital speech waveform to a central server 206. The above-mentioned abnormal information extraction process performed on the central server 206 may be performed on the central processing unit 203 as a processing section of the computing device 201. Depending on cases, this specification uses the term "processing section" to collectively represent the computing devices 102-1 through 102-N and the central processing unit (CPU) of the central server 103.

Various programs executed by the central processing unit 203 are stored in nonvolatile memory 205. The programs are read for execution and are loaded into volatile memory 204. Work memory needed for program execution is allocated to the volatile memory 204. In the central server 206, a central processing unit 207 as a processing section executes various programs. The programs executed by the central processing unit 207 are stored in nonvolatile memory 209. The programs are read for execution and are loaded into volatile memory 208. Work memory needed for program execution is allocated to the volatile memory 204. The signal processing is performed in the central processing unit 207 of the central server 206 or the central processing unit 203 of the computing device 201. The signal processing depends on installation positions of the microphone array in the environment for maintenance and monitoring when the microphone array recorded analog sound pressure values to be processed. The signal processing also depends on which apparatus and which range of the apparatus should be targeted for maintenance and monitoring based on the recording information.

As shown in FIGS. 1 and 2, one microphone array corresponds to one computing device. However, the configuration is not limited to one-to-one correspondence. There may be another configuration in which one computing device may process information on two or more microphone arrays. When one A/D converter processes information on two or more microphone arrays, it is possible to synchronously process information on these microphone arrays. There may be still another configuration in which one A/D converter processes information on two or more microphone arrays. There may be yet another configuration in which multiple computing devices process information on one microphone array. Such configuration is useful in a case where the amount of throughput is too large for one computing device to process.

Figure 3:
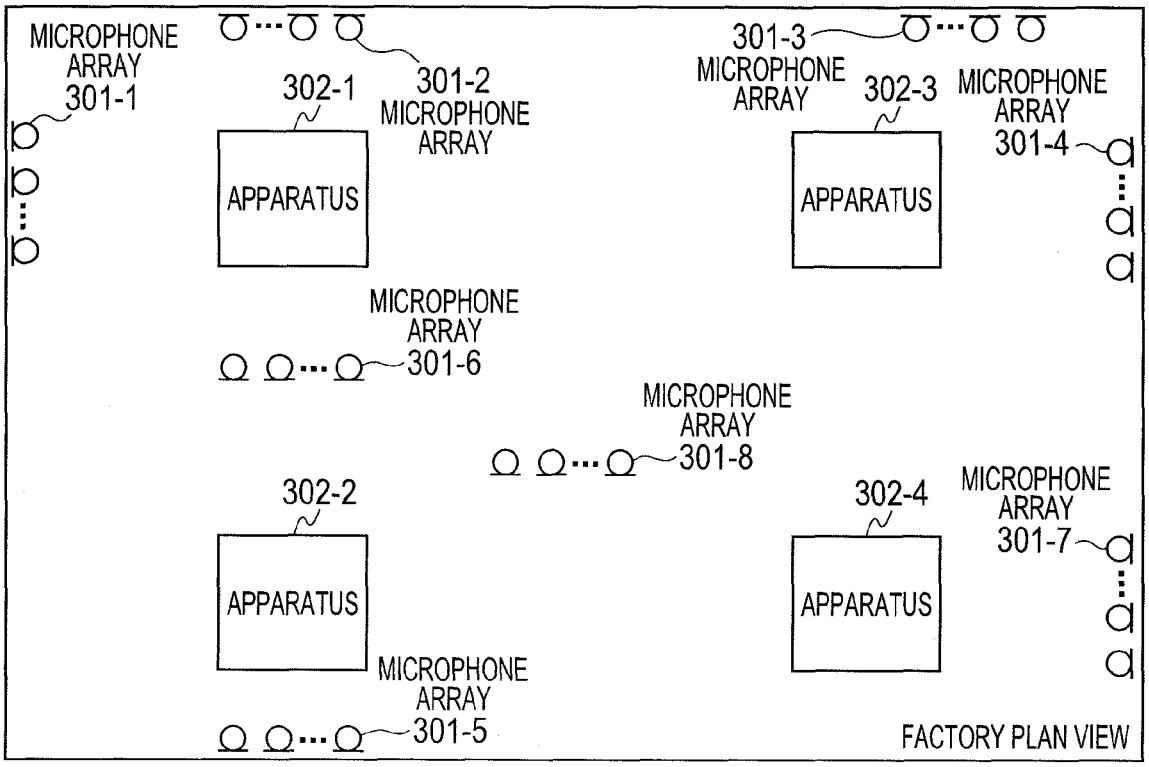
FIG. 3 exemplifies hardware layout in a factory according to the first embodiment.

FIG. 3 exemplifies an installation layout of microphone arrays according to the embodiment and illustrates how the central processing unit performs different processes depending on the relative positional relation with apparatuses. Microphone arrays 301-1 through 301-8 correspond to the microphone arrays 101-1 through 101-N in FIG. 1. The microphone arrays 301-1 through 301-8 spread across the environment at different positions and monitor operations of apparatuses 302-1 through 302-4. It is inappropriate to use the microphone array 301-7 or 301-4 for monitoring the apparatus 302-1. This is because the microphone array 301-7 or 301-4 as a sound information input section receives sound information generated from the apparatus 302-3 or 302-4 and hardly records sound from the apparatus 302-1 at a high signal-to-noise ratio (SNR). In this case, it is desirable to use the microphone array 301-1, 301-2, or 301-6. All of or the nearest one of these microphone arrays may be used to monitor the sound from the apparatus 302-1. There may be a case where the sound information needs to be monitored at specific part of the apparatus 302-1 and there is an obstacle along the straight line between the apparatus 302-1 and the microphone array. Even the apparatus 302-1 itself might be an obstacle. In such a case, it may be preferable to avoid using the microphone array even though it is the nearest one.

Figure 4:
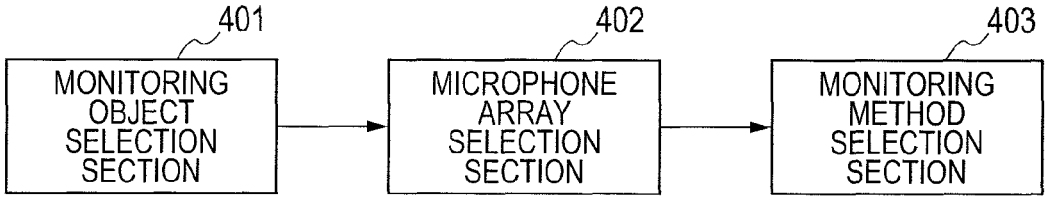
FIG. 4 shows a software function block configuration in a central server according to the first embodiment.

FIG. 4 shows the software block configuration of a program that is executed by the processing section in the central server 206 according to the embodiment and selects a monitoring method for each apparatus to be monitored. A monitoring object selection section 401 provides a means for an operator or a responsible person at the monitoring location to select an apparatus to be monitored. For example, the monitoring object selection section 401 may be configured to use the graphical user interface (GUI) for ordinary computers, display a plan view of the monitoring location on a display device as a display section, and allow a user to specify an apparatus to be monitored using a mouse. The monitoring object selection section 401 may be also configured to provide a list box of apparatuses to be monitored and allow a user to select an intended apparatus from the list. The monitoring object selection section 401 acquires a monitoring location or a relative coordinate of the monitoring object in the monitoring environment from the apparatus selected by the GUI-based method for monitoring.

A microphone array selection section 402 selects a microphone array to be monitored by comparing the relative coordinate (monitoring location) of the monitoring object acquired from the monitoring object selection section 401 with a predefined microphone array database. A monitoring method selection section 403 selects an appropriate sound field monitoring function based on the location of the selected microphone array and directional characteristics.

The microphone arrays 302-1 through 302-8 may transmit sound information to the central server 206. The central server 206 may then perform a selected sound field monitoring means. Based on the selected sound field monitoring means, information about the sound field monitoring means may be transmitted to the computing device 201 that processes data for each microphone array. The sound field monitoring means may be executable on the processing section of each computing device. In this case, the sound field monitoring means is supplied to the computing device and needs to be executable only on the microphone array corresponding to the computing device. In other words, there may be a need for using information on the microphone array corresponding to another computing device. The sound field monitoring means is preferably performed on the processing section of the central server. On the other hand, the sound field monitoring means may monitor sound information using only data for the microphone array corresponding to a specific computing device. In such a case, that computing device performs the sound field monitoring means and transmits only a monitoring result to the central server. It is possible to reduce network costs of transmitting information to the central server.

The predefined microphone array database records at least: a microphone identifier (ID) for uniquely identifying the microphone array; the relative coordinate value of a monitoring object in the monitoring environment; the directivity of a microphone included in the microphone array; the identifier (ID) of an A/D converter as a board connected to the microphone array; and the attribute of a channel number for the microphone array connected to the A/D converter. The database is stored in the volatile memory 208 or the nonvolatile memory 209 as a storage section of the central server 206.

Figures 10, 11:
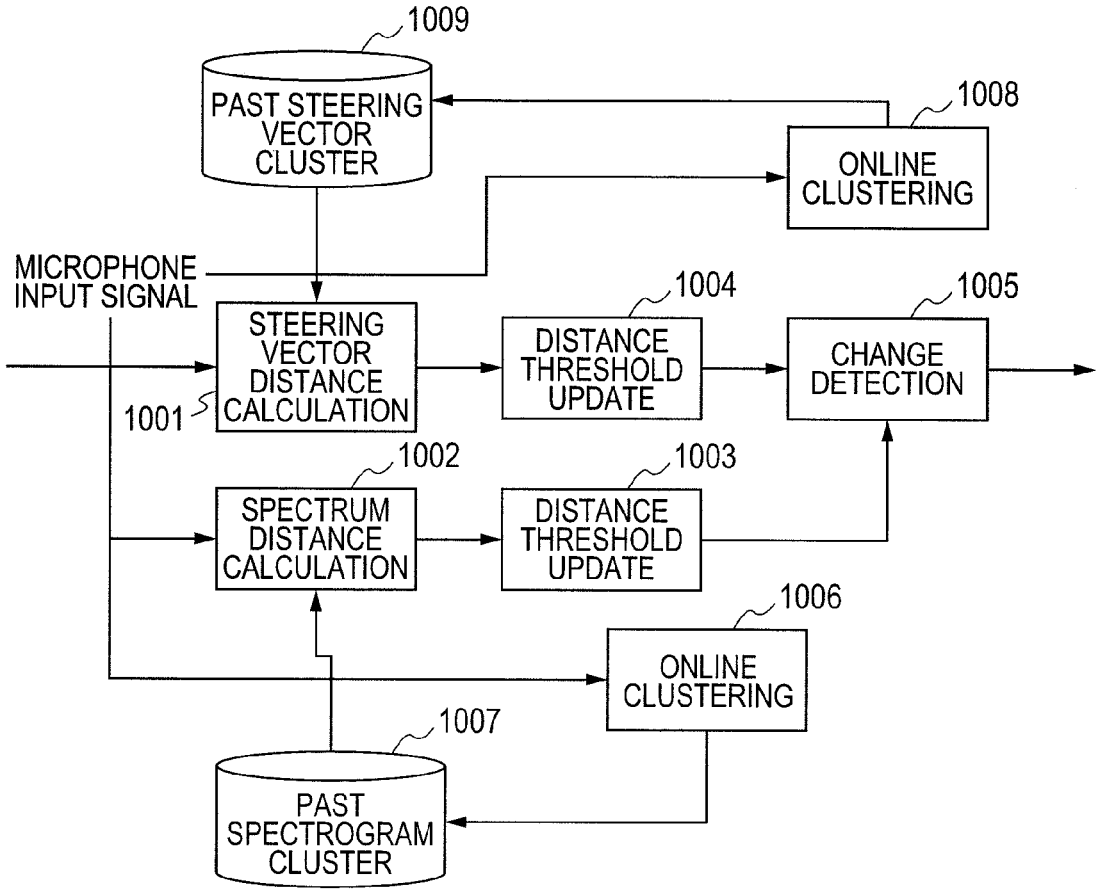
FIG. 10 shows a block configuration for abnormal sound detection without sound source direction estimation processing according to the first embodiment.
FIG. 11 shows a configuration of a microphone attribute information table as a microphone database according to the first embodiment.

FIG. 11 exemplifies the microphone array database (DB) or a microphone attribute information table according to the embodiment. Columns 1101 through 1105 respectively denote the microphone ID, the coordinate value, the directivity, the A/D converter, and the channel as mentioned above. When the microphone array contains one microphone, the "channel" column 1105 shows the channel number of the A/D converter 202 connected to the microphone. When the microphone array contains multiple microphones, the "channel" column 1105 shows a series of channel numbers corresponding to the microphone arrays. The same A/D converter may or may not be connected to the microphone arrays.

Characteristics of the A/D converters are also stored in a database (DB). The A/D converter database stores at least three attributes: an A/D converter ID for uniquely identifying the A/D converter; the IP address of a PC connected to the A/D converter; and temporal "synchronization" between channels of the A/D converter. The database may preferably store a program port number as an attribute for acquiring data on the A/D converter.

Figures 12, 13:
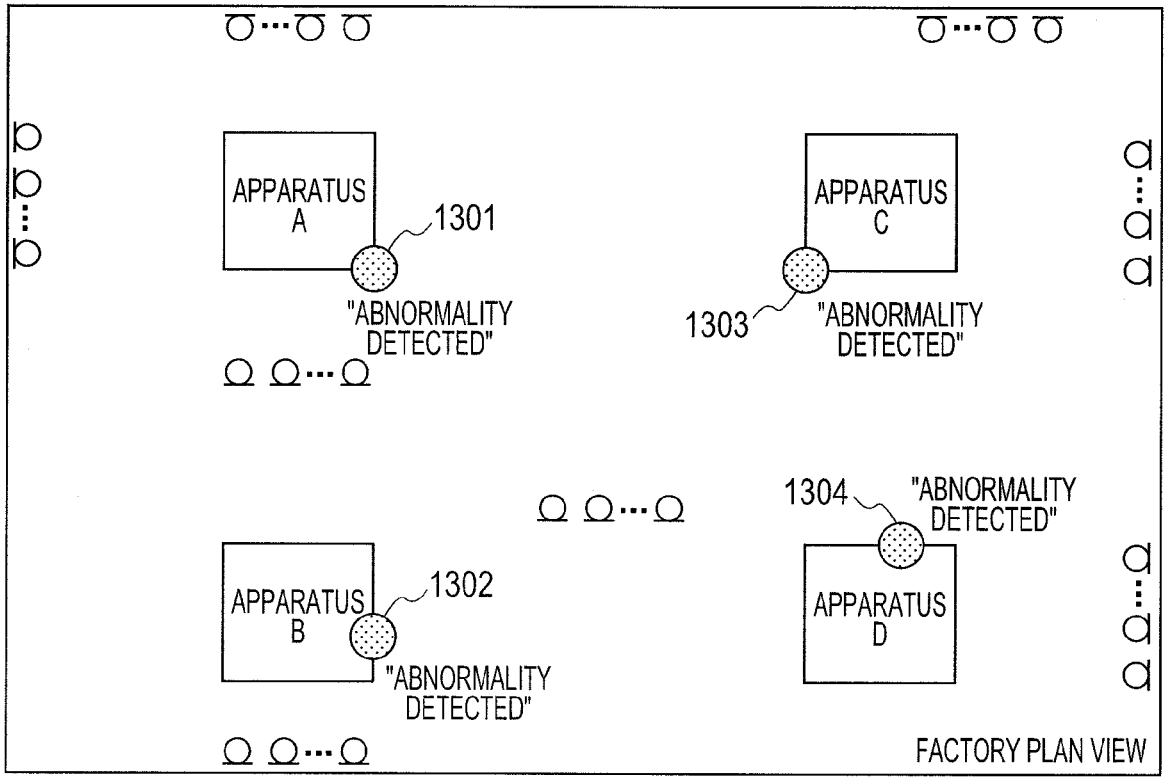
FIG. 12 shows a configuration of an AD converter attribute information table as an AD converter database according to the first embodiment.
FIG. 13 shows a GUI configuration of an abnormality detection screen according to the first embodiment.

FIG. 12 exemplifies the A/D converter database or an A/D converter attribute information table. In FIG. 12, columns 1201 through 1203 respectively denote three attributes, namely, the A/D converter ID, the IP address of the PC connected to the A/D converter, and temporal "synchronization" between channels of the A/D converter as mentioned above. The temporal synchronization is ensured when a ratio of a difference in the synchronization between channels to a sampling period of the A/D converter is smaller than or equal to a predetermined threshold value. The table is also stored in the storage section of the central server 206.

Figure 5:
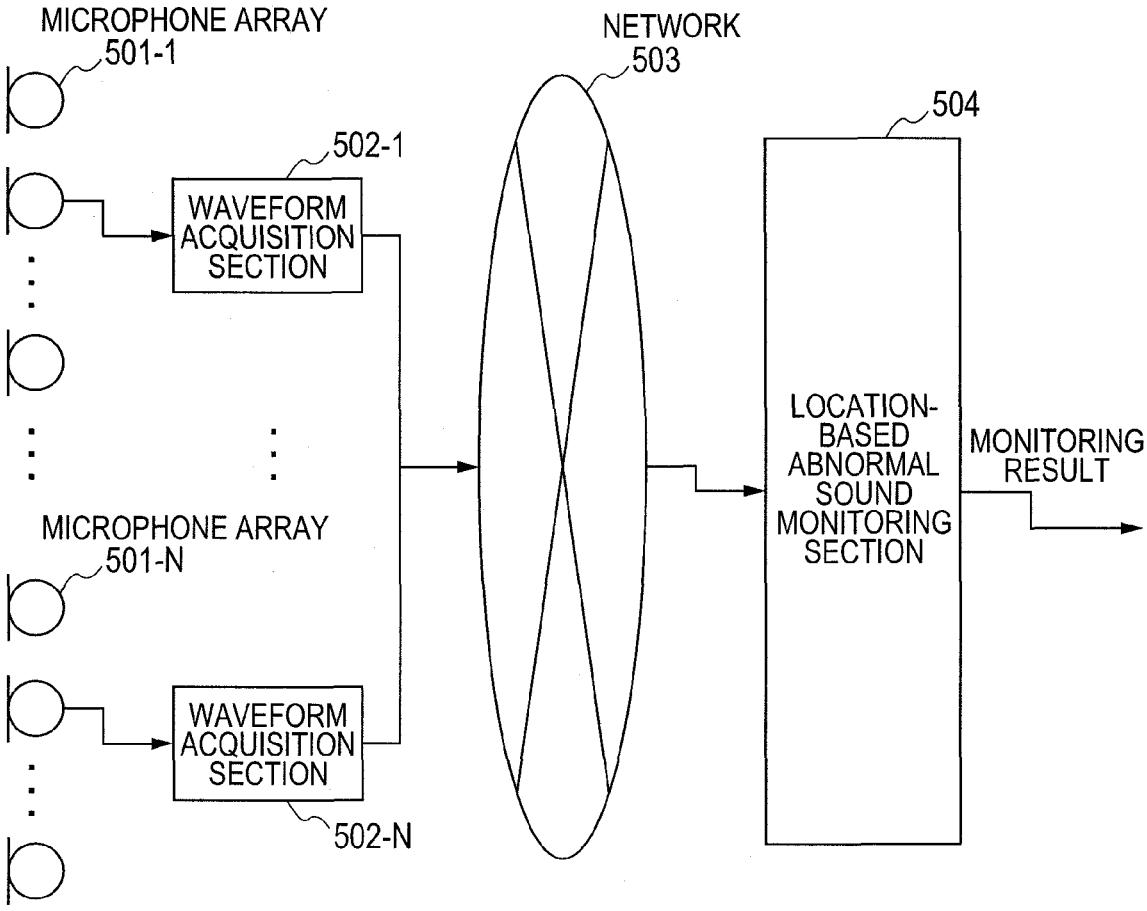
FIG. 5 shows a software block configuration for abnormal sound monitoring in the central server according to the first embodiment.

FIG. 5 shows a software block according to the embodiment. The computing device at each location allows the sound field monitoring means to record speech and transmits speech data to the central server via a network. The central server processes the speech data. Microphone arrays 501-1 through 501-N are equivalent to the microphone arrays 101-1 through 101-N and acquire sound pressure values. Waveform acquisition sections 502-1 through 502-N operate in the computing devices (at respective locations), process the sound pressure values, and transmit these values to a central server equivalent to the central server 103 or 206 via a network 503. In the central server, the central processing unit 207 executes a location-based abnormal sound monitoring section 504 as a program. The location-based abnormal sound monitoring section 504 processes waveforms acquired from the locations and detects an abnormal state. The location-based abnormal sound monitoring section 504 then transmits a monitoring result to the monitoring screens 104-1 through 104-S.

Figure 6:
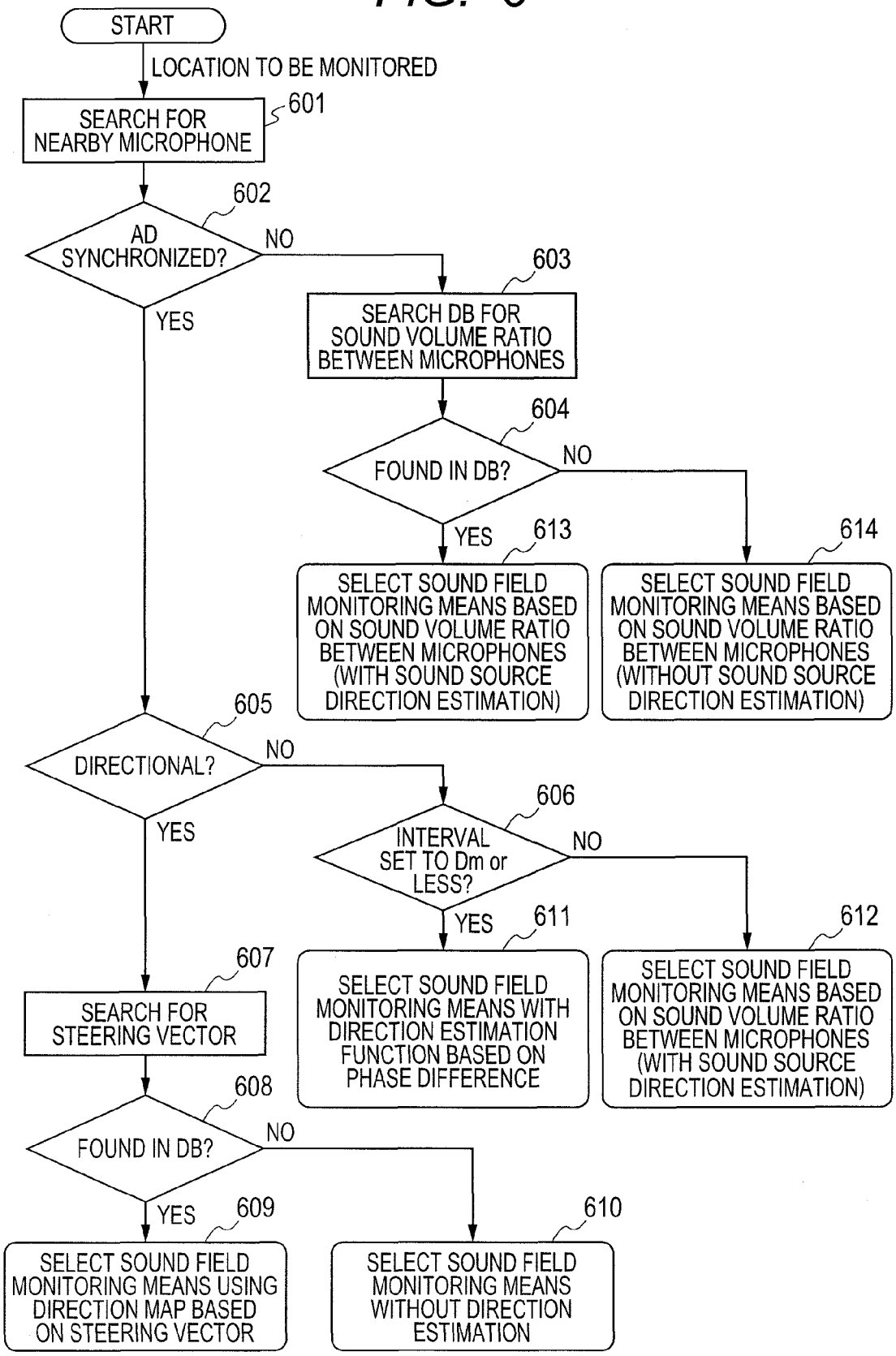
FIG. 6 shows a selection flow of an abnormal sound monitoring function according to the first embodiment.

FIG. 6 shows a processing flow of the microphone array selection section 402 and the monitoring method selection section 403, the programs executed on the central server as shown in FIG. 4. As mentioned above, the monitoring object selection section 401 identifies a monitoring location from a given apparatus to be monitored. Let us suppose that the monitoring location is represented by (X1, Y1, Z1) as a local coordinate system in the monitoring environment. At step 601, the program searches for a nearby microphone and calculates distances between the monitoring location and N microphone arrays. Let us suppose (Xi, Yi, Zi) to be the central coordinate system of each microphone array, where i is the index for identifying the microphone array. The central coordinate system can be found from a coordinate value 1102 in the above-mentioned microphone array database.

The distance calculation is based on three-dimensional Euclidean distance $di=(X1-Xi)^2+(Y1-Yi)^2+(Z1-Zi)^2$. It may be preferable to select a microphone array with minimum di as the nearby microphone array or select multiple microphone arrays whose di is smaller than or equal to a predetermined threshold value. The processing flow in FIG. 6 selects a microphone array with minimum di as the nearby microphone array. The sound field monitoring means using multiple microphone arrays will be described later. The microphone array is supposed to contain two microphones. A configuration of three or more microphones will be described later.

At step 602 in FIG. 6, the program checks for AD synchronization. The program references the A/D converter database and checks for synchronization between channels of the A/D converter for recording sound from the selected microphone array. If the channels are synchronized with each other, the program can estimate the sound source direction at high resolution based on a phase difference. If the channels are not synchronized with each other, the program cannot estimate the sound source direction based on a phase difference. In this case, the program determines whether a sound volume ratio for the microphone in the microphone array is known. If the sound volume ratio is known, the program estimates the sound source direction at a low resolution using an amplitude ratio, for example. If the sound volume ratio is unknown, the program selects a sound field monitoring means that does not estimate the sound source direction.

At step 603, the program searches the DB for a sound volume ratio between microphones and determines whether the DB records a sensitivity ratio between two microphones. When a sensitivity ratio between two microphones is already measured, the program stores the ratio as a database in the nonvolatile memory 209 of the central server 206. At step 604, the program determines whether the DB stores a sound volume ratio. When the DB stores a sound volume ratio between microphones, the program selects a sound field monitoring means so as to locate the sound source based on the sound volume ratio (step 613).

The following describes how the program locates the sound source based on the sound volume ratio. Let us suppose that a signal of the same sound pressure level is supplied to microphones 1 and 2 included in the microphone array. The microphone 1 is assumed to indicate sound pressure level P1 [dB]. The microphone 2 is assumed to indicate sound pressure level P2 [dB]. The input signal for microphone 1 is assumed to indicate sound pressure level X1 [dB]. The input signal for microphone 2 is assumed to indicate sound pressure level X2 [dB]. Under these conditions, normalized sound pressure levels are expressed as N1=X1−P1 and N2=X2−P2. When a difference (N1−N2) between the normalized sound pressure levels is greater than or equal to predetermined threshold value Th1, the sound source is assumed to be located near the microphone 1. When the difference (N1−N2) is smaller than or equal to predetermined threshold value Th2, the sound source is assumed to be located near the microphone 2. In other cases, the sound source is assumed to be located intermediately between the microphones 1 and 2. It may be preferable to apply the fast frequency decomposition to an input signal based on the general Fourier transform and perform the above-mentioned determination on each of time-frequency components. Based on determination results, the program generates histograms for three cases, namely, the location assumed to be near the microphone 1, the location assumed to be near the microphone 2, and the location assumed to be intermediate between the microphones 1 and 2. The program monitors abnormal sound generation based on the histograms.

When the DB does not store a sound volume ratio between microphones at step 604, the program selects a sound field monitoring means that does not generate a histogram (step 614). The sound field monitoring means in this case will be described later.

When it is determined that the A/D converter is synchronized at step 602 in FIG. 6, the program determines at step 605 whether the microphone included in the targeted microphone array is directional or omnidirectional. This can be done by referencing directivity 1103 of the microphone array database in FIG. 11. When it is determined that the microphone is directional, the program searches for a steering vector at step 607 and determines whether steering vectors are already acquired corresponding to virtual sound source directions for the microphone array. There may be a case of previously recording impulse responses for the microphone array and acquiring phase differences between the microphones in sound source directions such as forward, sideways, and backward viewed from the microphone array. In such a case, it may be preferable to generate a steering vector from the supplied information and store the steering vector in the nonvolatile memory 209 of the central server 206. After step 607, the program determines at step 608 whether the DB contains a steering vector. When the DB contains a steering vector (yes), the program estimates the sound source direction using the steering vector (step 609). Let us suppose that xm(f, τ) represents a signal at frequency f and frame τ for the mth microphone. This can be done by applying the fast Fourier transform to a signal for the mth microphone. Equation 1 below defines a vector containing the microphones signals as components.

[Equation 1]

$$x(f,\tau)=[x_1(f,\tau)x_2(f,\tau)]^T \quad \text{(Equation 1)}$$

Equation 2 defines a steering vector in sound source direction p.

[Equation 2]

$$a_p(f)=[a_1(f)\exp(jT_{p,1}(f))a_2(f)\exp(jT_{p,2}(f))]^T \quad \text{(Equation 2)}$$

In this equation, $T_{p,m}(f)$ is the delay time for the sound transmitted from the sound source to microphone m and αm(f) is the attenuation rate for the sound transmitted from the sound source to microphone m. The delay time and the attenuation rate can be found by measuring impulse responses from the sound source directions. The equation normalizes a(f)=a(f)/|a(f)| so that steering vector a(f) is set to 1 in size.

Equation 3 is used to estimate the sound source direction for each time-frequency component using steering vectors.

[Equation 3]

$$P_{min} = \arg\max_p |a_p(f)^* x(f,\tau)|^2 \quad \text{(Equation 3)}$$

Let us suppose that Pmin is the index representing an estimated sound source direction. A direction causing the maximum inner product between an input signal and a steering vector is assumed to be the time-frequency sound source direction at a given time frequency. The sound field monitoring means using steering vectors calculates a histogram of sound source direction Pmin found at every time frequency. The program determines whether an abnormality occurs according to a change in the histogram. After the search for a steering vector at step 607, there may be a case where the DB contains no steering vector. In this case, the program selects a sound field monitoring means not using a sound source direction histogram without direction estimation and then terminates (step 610).

When it is determined at step 605 that the microphone is omnidirectional (no), the program then determines at step 606 whether the interval between microphones is smaller than or equal to D[m]. When the interval is smaller than or equal to D[m], the program selects a sound field monitoring means that uses the sound source direction estimation based on a phase difference between microphones (step 611). The sound source direction estimation based on a phase difference finds sound source direction θ(f, τ) from input signal X(f, τ) using equation 4.

[Equation 4]

$$\theta(f,\tau) = \frac{1}{2\pi f d c^{-1}} \arctan \frac{x_1(f,\tau)}{x_2(f,\tau)} \left| \frac{x_2(f,\tau)}{x_1(f,\tau)} \right| \quad \text{(Equation 4)}$$

In equation 4, d is assumed to be the microphone interval and c is the sonic speed. The program determines whether an abnormality occurs based on a change in the histogram for the calculated sound source direction $\theta(f, \tau)$. It may be preferable to find sound source direction $\theta(\tau)$ for every time frame in accordance with GCC-PHAT (Generalized Cross Correlation with Phase Transform) or equivalent sound source direction estimation techniques using all frequencies for every time frame.

It may be preferable to generate a histogram by dispersing sound source directions at a proper interval. There may be a case where the interval between microphones is greater than or equal to predetermined D[m] as a result of the determination at step 606 (no). In this case, the program assumes it difficult to estimate the sound source direction based on a phase difference. The program selects a sound field monitoring means that estimates the sound source direction based on a sound volume ratio between microphones (step 612). There is provided ratio r [dB] between an input signal for the microphone 1 and a sound pressure for the microphone 2 at every frequency. When r [dB] is greater than predetermined threshold value T1 [dB], the frequency component is assumed to belong to the sound source near the microphone 1. When r [dB] is smaller than predetermined threshold value T2 [dB], the frequency component is assumed to belong to the sound source near the microphone 2. In other cases, the frequency component is assumed to be intermediate between the microphones 1 and 2. The program performs the above-mentioned determination on each time frequency. Based on determination results, the program then generates histograms for three cases, namely, the location assumed to be near the microphone 1, the location assumed to be near the microphone 2, and the location assumed to be intermediate between the microphones 1 and 2. The program monitors abnormal sound generation based on the histograms. The processing flow in FIG. 6 determines the sound field monitoring means at each monitoring location.

The following describes a case where the microphone array includes three microphones or more. The program finds the sound source direction based on a sound volume ratio between microphones as follows. The program extracts two microphones that generate highest volumes. When the sound volume ratio between the microphones exceeds predetermined threshold value T1 [dB], the program assumes the sound source to be near the extracted microphone 1. When the sound volume ratio is below T2 [dB], the program assumes the sound source to be near the extracted microphone 2. In other cases, the program assumes the sound source to be near the extracted microphones 1 and 2. The program acquires a sound source direction estimation result such as the sound source near microphone i or intermediate between microphones i and j at every time frequency. Based on the estimation result, the program calculates a histogram and uses it for sound monitoring. When using a steering vector for the sound source direction estimation, the program calculates an inner product between three or more steering vectors and three or more input signals.

When using a phase difference for the sound source direction estimation, the program uses SRP-PHAT (Steered Response Power-Phase Alignment Transform) or SPIRE (Stepwise Phase Difference Restoration). For the latter, refer to M. Togami and Y. Obuchi, "Stepwise Phase Difference Restoration Method for DOA Estimation of Multiple Sources", IEICE Trans. on Fundamentals, vol. E91-A, no. 11, 2008, for example.

Figure 7:
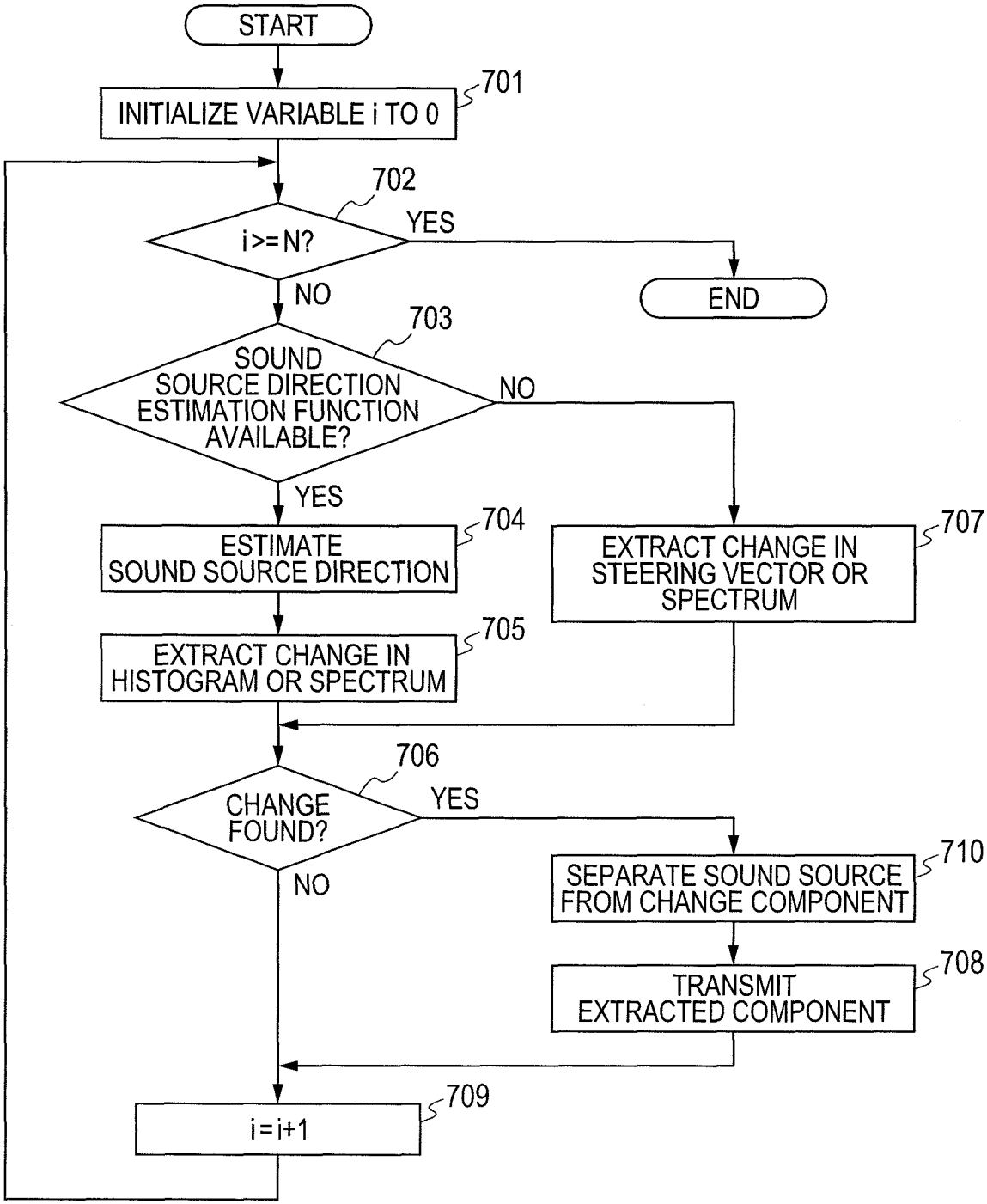
FIG. 7 shows a processing flow of the abnormal sound monitoring function according to the first embodiment.

FIG. 7 shows a processing flow of frame-based sound monitoring at all locations in the processing section of the central server 206 according to the embodiment. At step 701, the program initializes index (i) to 0, where index (i) is the variable for a location to be processed. At step 702, the program determines whether all locations have been processed, where N is the number of locations. When all locations have been processed, the program terminates. Otherwise, the program proceeds to step 703 and determines whether the sound field monitoring means at that location has the sound source direction estimation function. When it is determined that the sound field monitoring means has the sound source direction estimation function, the program estimates the sound source direction at step 704. The sound source direction estimation is based on the method selected by the sound field monitoring means selection. The program selects the method using phase differences, the method based on sound volume ratios, or the method using steering vectors. The program estimates the sound source direction at every frequency. From the estimation result, the program extracts a change in the histogram or the input signal spectrum at step 705. When the sound field monitoring means does not have the sound source direction estimation function, the program extracts a temporal change in the steering vector or a change in the input signal spectrum at step 707. At step 706, the program determines whether the histogram or the input signal spectrum indicates a remarkable temporal change. When it is determined that a temporal change is detected, the program separates the changed sound source direction component from the sound source at step 710. For example, the program performs the sound source separation at step 710 using the minimum variance beamformer (e.g., refer to M. Togami, Y. Obuchi, and A. Amano, "Automatic Speech Recognition of Human-Symbiotic Robot EMIEW," in "Human-Robot Interaction", pp. 395-404, I-tech Education and Publishing, 2007). During the sound source separation, the program extracts data for several seconds before and after the estimated change. The program transmits the extracted component to the monitoring locations at step 708 and proceeds to the next step 709. When it is determined at step 706 that no change is indicated, the program advances the processing to the next location (step 709).

Figure 8:
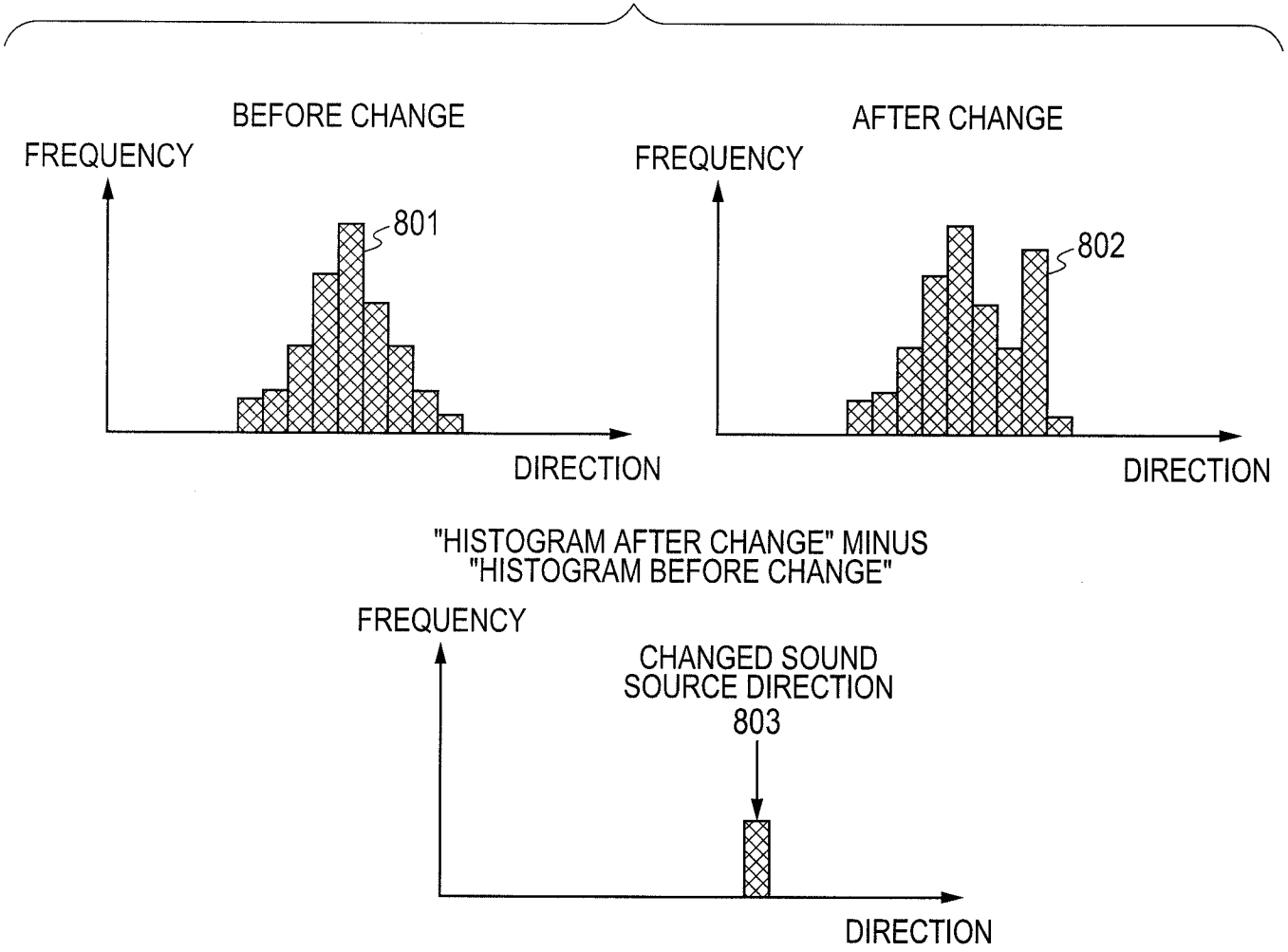
FIG. 8 schematically shows abnormality determination examples by extracting changes in sound source direction histograms according to the first embodiment.

FIG. 8 illustrates how to extract a change in the sound source direction histogram according to the embodiment. A sound source direction 803 at the bottom of FIG. 8 can be found by subtracting a histogram 801 before change at the top right thereof from a direction histogram 802 after change at the top left thereof.

Figure 9:
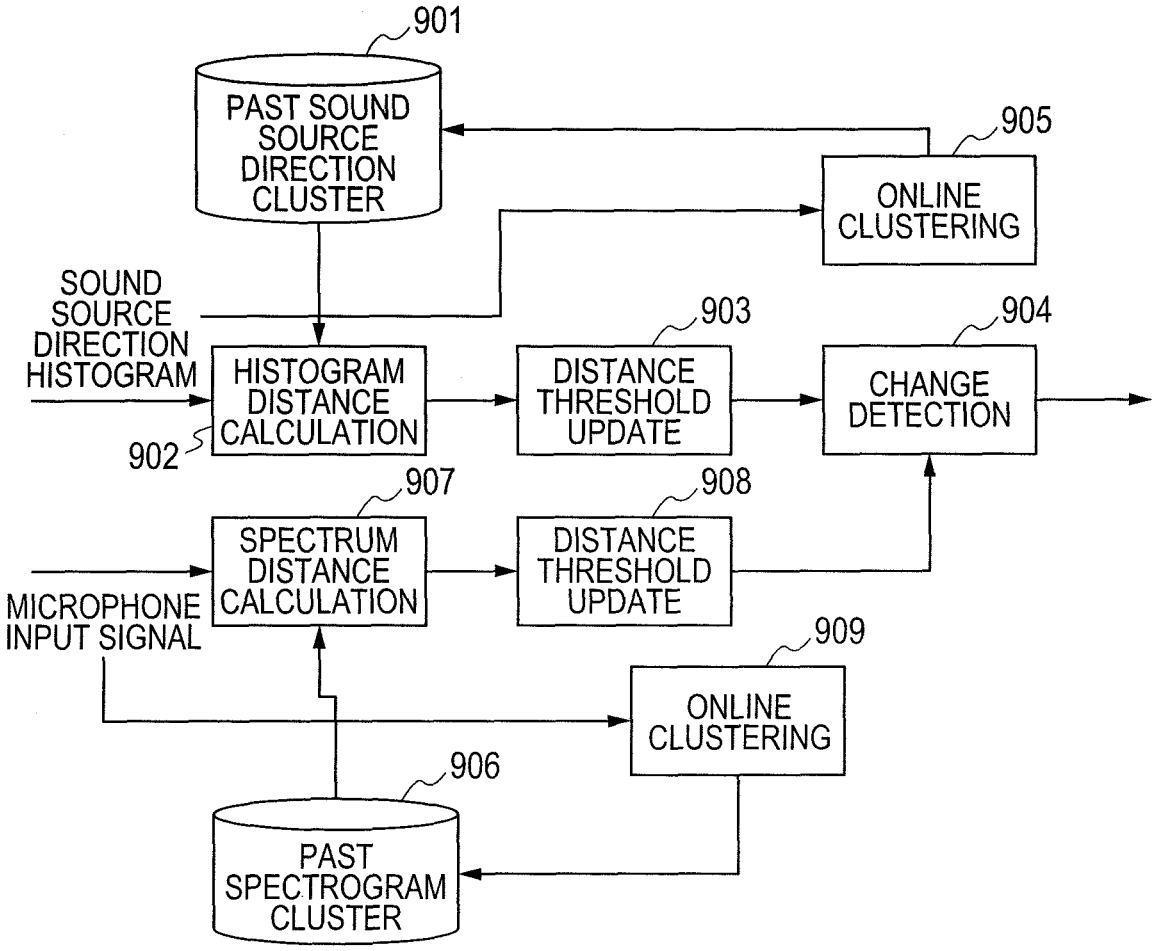
FIG. 9 shows a block configuration for abnormal sound detection with sound source direction estimation processing according to the first embodiment.

FIG. 9 shows a more detailed processing flow at step 705 of the processing flow in FIG. 7 for extracting a change in the histogram or the input signal spectrum when the sound source direction estimation function is provided. A block of histogram distance calculation 902 calculates a histogram distance from the estimated sound source direction histogram. The block 902 uses information on a past sound source direction cluster 901 stored in the memory to calculate the distance between the estimated sound source direction histogram and the past cluster. The distance calculation is based on equation 5.

[Equation 5]

$$Sim = \max_{c} \frac{|Q_c * H|}{|Q_c||H|} \quad \text{(Equation 5)}$$

In this equation, Qc is assumed to be the centroid of the cth cluster. H is assumed to be the generated sound source direction histogram. The ith element of H is assumed to be the frequency of the ith element of the generated histogram. The value of Sim approximates 1 when the distance from past clusters is small. The value of Sim approximates 0 when the distance from any of past clusters is large. The value of H may be replaced by a histogram generated for each frame or a moving average of these histograms in the time direction. A block of distance threshold update 903 uses value AveSim as a moving average of Sim in the time direction and finds Th like Th=AveSim+(1−AveSim)*β. A block of online clustering 905 finds index Cmin for the cluster nearest to the generated sound source direction histogram using equation 6.

[Equation 6]

$$C_{min} = \underset{c}{\operatorname{argmax}} \frac{|Q_c * H|}{|Q_c||H|} \quad \text{(Equation 6)}$$

Equation 7 updates Qcmin.

[Equation 7]

$$Q_{cmin} \leftarrow \lambda Q_{cmin} + (1-\lambda)H \quad \text{(Equation 7)}$$

In the equation, λ is assumed to be the forgetting factor for the past information. The updated value of Qcmin is written to the past sound source direction cluster 901. A block of spectrum distance calculation 907 finds S(τ) in the time direction from the supplied microphone input signal using equation 8.

[Equation 8]

$$S(\tau)=[S_1(\tau)S_2(\tau) \ldots S_F(\tau)]^T \quad \text{(Equation 8)}$$

Equation 9 defines Si(τ).

[Equation 9]

$$S_i(\tau) = \log \sum_{f \in \Omega_i} W(f)\|x(f, \tau)\|^2 \quad \text{(Equation 9)}$$

In the equation, Ωi is assumed to be a set of frequencies contained in the ith sub-band. W(f) is assumed to the weight of frequency f in the sub-band. The set of frequencies for each sub-band is assumed to be divided at regular intervals with reference to the logarithmic frequency scale. W(f) is assumed to form a triangle window whose vertices correspond to center frequencies of the sub-bands. The block 907 calculates a distance between the acquired S(τ) and the centroid of each cluster contained in a past spectrogram cluster 906 and calculates similarity Simspectral with the centroid using equation 10.

[Equation 10]

$$Sim_{speciral} = \underset{c}{\operatorname{argmax}} \frac{|K_c * S|}{|K_c||S|} \quad \text{(Equation 10)}$$

A block of distance threshold update 908 in FIG. 9 uses the value of AveSimspectral as a moving average of Simspectral in the time direction and finds Thspectral like Thspectral=AveSimspectral+(1−AveSimspectral)*β.

A block of online clustering 909 finds Cmin using equation 11 and updates Kcmin using equation 12.

[Equation 11]

$$C_{mim} = \underset{c}{\operatorname{argmax}} \frac{|K_c * S|}{|K_c||S|} \quad \text{(Equation 11)}$$

-continued

[Equation 12]

$$K_{c\ min} \leftarrow \lambda K_{c\ min} + (1-\lambda)S \quad \text{(Equation 12)}$$

A block of change detection 904 determines that a change is detected when AveSim exceeds Th or Avesimspectral exceeds Thspectral. Otherwise, the block determines that no change is detected.

FIG. 10 shows a detailed block configuration for change detection in a sound field monitoring means without sound source direction estimation. Blocks of spectrum distance calculation 1002, distance threshold update 1003, online clustering 1006, and past spectrogram cluster 1007 perform the processing similar to that of the equivalent blocks in FIG. 9. A block of steering vector distance calculation 1001 finds an input signal normalized by equation 13 as N(f, τ) from the supplied microphone input signal.

[Equation 13]

$$N(f, \tau) = \frac{x(f, \tau)}{x_1(f, \tau)}|x_1(f, \tau)| \quad \text{(Equation 13)}$$

The block 1001 calculates a distance to the centroid of a past steering vector cluster 1009 using equation 14 to find similarity Simsteering.

[Equation 14]

$$Sim_{steering} = \sum_f \max_c \frac{|J_c(f) * N(f, \tau)|}{|J_c(f)||N(f, \tau)|} \quad \text{(Equation 14)}$$

A block of distance threshold update 1004 uses the value of AveSimsteering as a moving average of Simsteering in the time direction and finds Thsteering like Thsteering=AveSimsteering+(1−AveSimsteering)*β. A block of online clustering 1008 finds Cmin using equation 15 and updates the centroid using equation 16.

[Equation 15]

$$C_{mim}(f) = \underset{c}{\operatorname{argmax}} \frac{|J_c(f) * N(f, \tau)|}{|J_c(f)||N(f, \tau)|} \quad \text{(Equation 15)}$$

[Equation 16]

$$J_{c\ min}(f) \leftarrow \lambda J_{c\ min}(f) + (1-\lambda)N(f, \tau) \quad \text{(Equation 16)}$$

A block of change detection 1005 determines that a change is detected when AveSimsteering exceeds Thsteering or AveSimspectral exceeds Thspectral. Otherwise, the block determines that no change is detected.

FIG. 13 exemplifies the configuration of a monitoring screen according to the embodiment corresponding to the factory plan view as shown in FIG. 3. When the sound field monitoring means detects an abnormal change, its location is specified by the sound source direction estimation. A user can be notified of abnormality locations 1301 through 1304 or text such as "abnormality detected" displayed on the screen. According to a preferred configuration, the user may click the text such as "abnormality detected" to separate and generate the corresponding abnormal sound so that the user can hear it. When a hearing direction is known, sound data corresponding to the change component can be extracted by applying the minimum variance beamformer that specifies the hearing direction.

Figure 14:
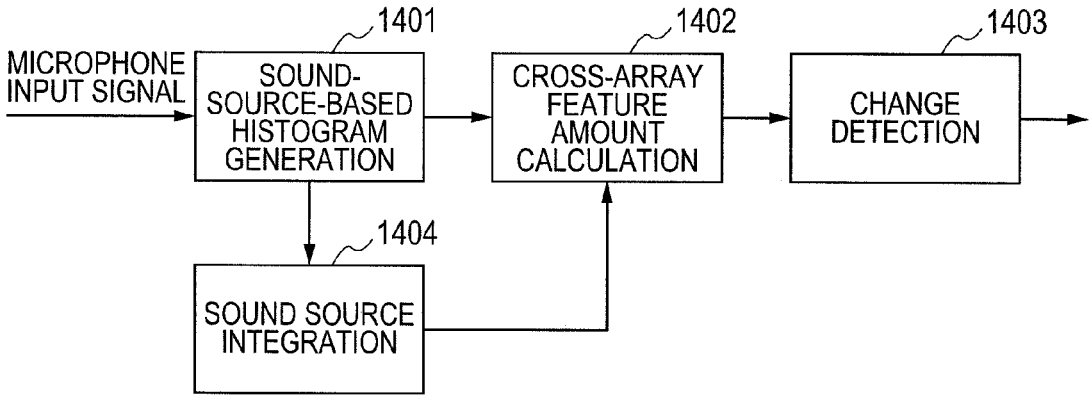
FIG. 14 shows a configuration of an abnormality change extraction block based on the entropy of sound source histograms according to the first embodiment.

FIG. 14 shows an abnormal change extraction block using multiple microphones. A block of sound-source-based histogram generation 1401 generates a histogram from input signals supplied to the microphone arrays for each of the microphone arrays. The block of sound-source-based histogram generation 1401 once separates the input signal for each sound source and generates a histogram corresponding to each sound source. A block of sound source integration 1404 integrates the signals separated for the microphone arrays based on the degree of similarity. The block clarifies the correspondence between each sound source separated by a microphone array 1 and each sound source separated by microphone array n.

Equation 17 is used to find n(m2).

[Equation 17]

$$n(m2) = \underset{m2}{\operatorname{argmin}} \sum_{m} C_{n,(m,m2[m])} \quad \text{(Equation 17)}$$

In the equation, n(m2) is the index indicating that the sound source is equal to the n(m2)[m]-th sound source of microphone array n while the sound source of the microphone array 1 is used as input. Cn(m, m2[m]) is assumed to be a function used to calculate a cross-correlation value between the mth sound source of the microphone array 1 and the m2[m]-th sound source of microphone array n. Equation 18 defines a function for calculating cross-correlation values using Sn(m) as a time domain signal (time index t omitted) for the mth sound source of microphone array n.

[Equation 18]

$$C_{n,(m,m2[m])} = \frac{E[S_1(m)S_n(m2[m])]}{E[S_1(m)^2]E[S_n(m2[m])^2]} \quad \text{(Equation 18)}$$

The block of sound source integration converts the index for each microphone array so that the m2[m]-th sound source corresponds to the mth sound source. A block of cross-array feature amount calculation 1402 specifies the location and the orientation of sound source generation for each sound source using multiple arrays. When there is an obstacle along the straight line between the sound source and the microphone array, a signal generated from the sound source does not directly reach the microphone array. In this case, estimating the orientation of the sound source generation makes it possible to select a microphone array free from an obstacle along the straight line. A block of change detection 1403 identifies a change in the location or the orientation of sound source generation or in the spectrum structure. When a change is detected, the block displays it on the monitoring screen as a display section.

Figure 15:
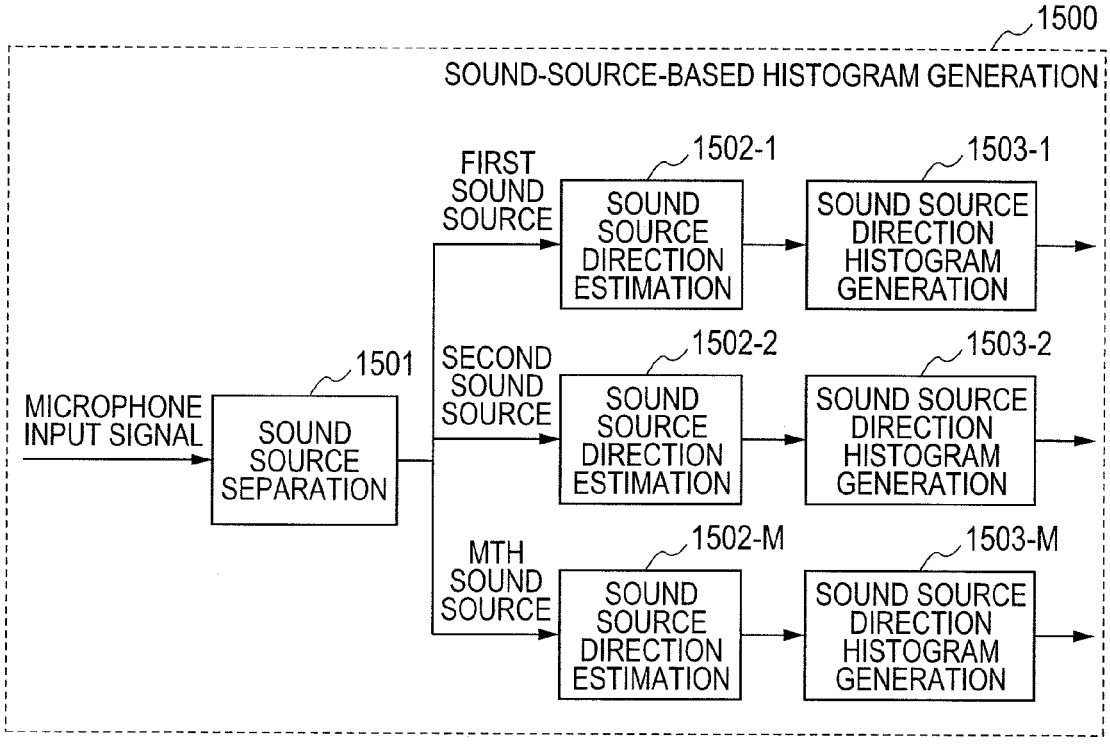
FIG. 15 shows a configuration of a sound-source-based histogram generation block according to the first embodiment.

FIG. 15 shows a detailed block configuration of sound-source-based histogram generation. A block of sound-source-based histogram generation 1500 includes three blocks: sound source separation 1501, sound source direction estimation 1502, and sound source direction histogram generation 1503. These three blocks are used for each microphone array. The block of sound source separation 1501 separates sound from each sound source using the general independent component analysis. The blocks of sound source direction estimation 1502-1 through 1502-M each estimate the sound source direction of each separated sound source. The sound source direction is selected for estimation based on the microphone array attribute information similarly to the selection of sound field monitoring means. The block of sound source direction histogram generation 1503 generates a histogram of the estimated sound source direction for each sound source.

Figure 16:
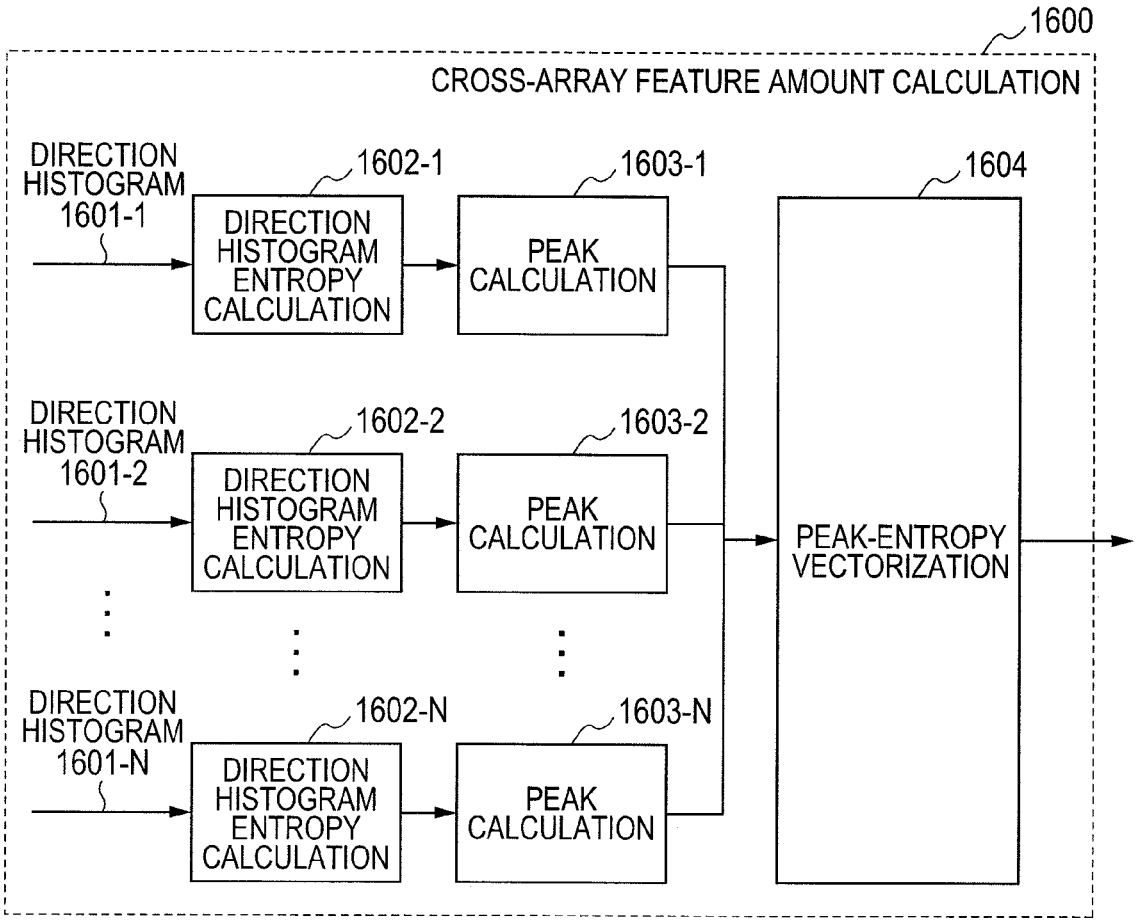
FIG. 16 shows a configuration of a cross-array feature amount extraction block according to the first embodiment.

FIG. 16 shows a detailed configuration of a cross-array feature amount extraction block. A cross-array feature amount extraction block 1600 includes direction histogram entropy calculation 1602, peak calculation 1603, and peak-entropy vectorization 1604. The cross-array feature amount extraction block is used for each sound source. A direction histogram is calculated on sound source m of microphone array n and is represented as Hn. Equation 19 calculates entropy Ent of Hn.

[Equation 19]

$$Ent = -\sum_{i} H_n(i)\log_2 H_n(i) \quad \text{(Equation 19)}$$

Hn is assumed to be normalized with size 1. Hn(i) is assumed to represent the frequency of the ith element. A larger value of Ent signifies that the estimated sound source directions are more diversified. The value of Ent tends to become large when the sound does not reach the microphone array due to an obstacle. The peak calculation blocks 1603-1 through 1603-N identify peak elements of histogram Hn and return sound source directions of the peak elements.

Entropy Ent for detecting the sound source orientation may be replaced by not only the peak-entropy vector but also histogram variance V(Hn) defined by equations 20 and 21, the variance value multiplied by −1, or the kurtosis defined by equation 22.

[Equation 20]

$$V(H_n) = \sum_{i} (H_n(i) - \overline{H_n})^2 \quad \text{(Equation 20)}$$

[Equation 21]

$$\overline{H_n} = \sum_{i} H_n(i) \quad \text{(Equation 21)}$$

[Equation 22]

$$K(H_n) = \frac{1}{(V(H_n))^2} \sum_{i} (H_n(i) - \overline{H_n})^4 \quad \text{(Equation 22)}$$

The histogram entropy, variance, or kurtosis can be generically referred to as "histogram variation".

The peak-entropy vectorization block 1604 calculates feature amount vector Vm whose elements are the sound source direction and the entropy calculated for each microphone array. Vm is assumed to be the feature amount vector of the mth sound source.

Figure 17:
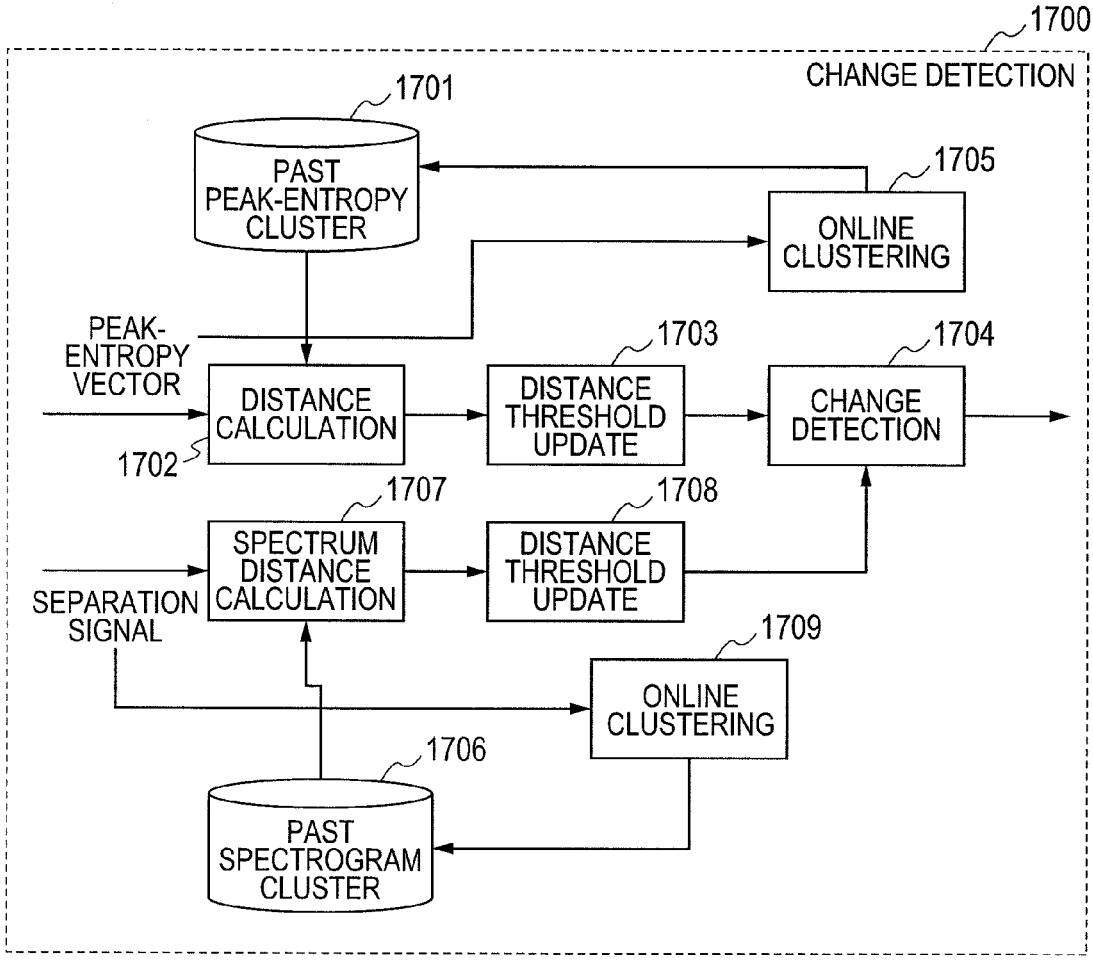
FIG. 17 shows a configuration of a change detection block according to the first embodiment.

FIG. 17 shows a block configuration for detecting a change based on feature amount vectors of sound sources calculated on multiple microphone arrays. A change detection block 1700 further includes blocks of spectrum distance calculation 1707, distance threshold update 1708, online clustering 1709, and past spectrogram cluster 1706. These blocks perform the processing similar to that of the equivalent blocks in FIG. 9. A distance calculation block 1702 calculates a distance to the centroid of a cluster in a past peak-entropy vector cluster 1701 using equation 23 and acquires similarity Simentropy.

[Equation 23]

$$Sim_{entropy} = \max_{c} \frac{|L_c * V_m|}{|L_c^*||V_m|} \quad \text{(Equation 23)}$$

A block of distance threshold update 1703 uses the value of AveSimentropy as a moving average of Simentropy in the time direction and finds Thentropy like Thentropy=AveSimentropy+(1−AveSimentropy)*β. A block of online clustering 1705 finds Cmin using equation 24 and updates the centroid using equation 25.

[Equation 24]

$$C_{min} = \underset{c}{\operatorname{argmax}} \frac{|L_c * V_m|}{|L_c^*||V_m|} \quad \text{(Equation 24)}$$

[Equation 25]

$$L_{c\ min} \leftarrow \lambda L_{c\ min} + (1 - \lambda) V_m \quad \text{(Equation 25)}$$

A block of change detection 1704 determines that a change is detected when AveSimentropy exceeds Thentropy or Thentropy exceeds AveSimentropy. Otherwise, the block determines that no change is detected.

Figure 18:
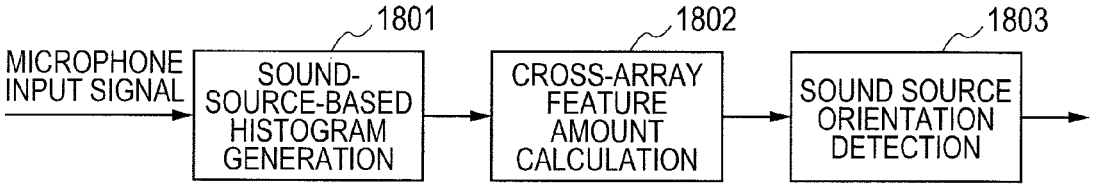
FIG. 18 shows a configuration of a sound source orientation detection block according to the first embodiment.

FIG. 18 shows a block configuration for detecting the sound source orientation from a microphone array input signal. Blocks of sound-source-based histogram generation 1801 and cross-array feature amount calculation 1802 perform the processing similar to that of the equivalent blocks in FIG. 14. A sound source orientation detection block 1803 detects the location and the orientation of a sound source from a peak-entropy vector that indicates a variation of histograms calculated for the sound sources. The peak-entropy vector is used as just an example and can be replaced by the above-mentioned histogram variance or kurtosis indicating the histogram variation.

Figure 19:
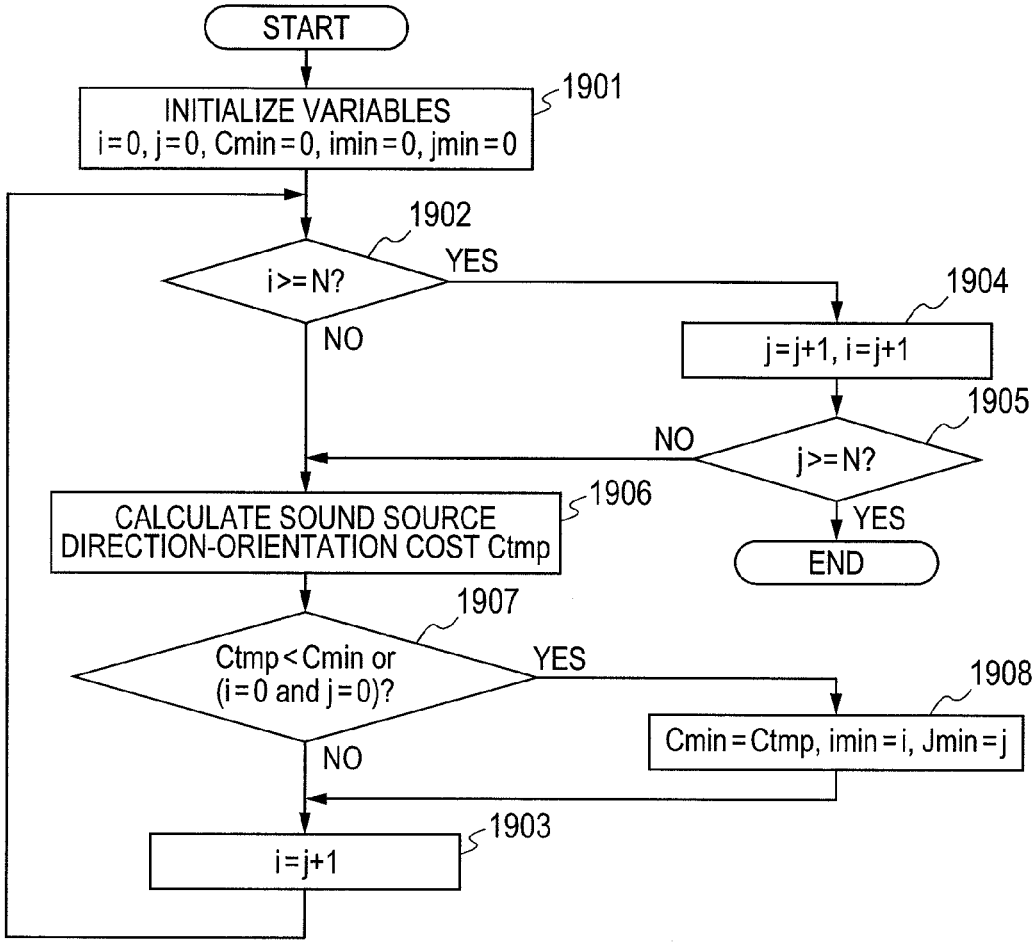
FIG. 19 exemplifies a processing flow of the sound source direction or orientation detection according to the first embodiment.

FIG. 19 shows a specific processing configuration of the sound source orientation detection block 1803. This processing flow is performed for each sound source. At step 1901, the program initializes variables such as indexes i and j for the microphone array and cost function Cmin. At step 1902, the program determines whether the last microphone array is processed. When the last microphone array is processed, the program proceeds to step 1904 for updating the variables. When the last microphone array is not processed, the program proceeds to step 1906 for calculating sound source direction-orientation cost Ctmp. When it is determined at step 1905 that the last microphone array has been processed according to j, the program terminates the processing and outputs indexes i and j for the microphone array and the location and the orientation of the sound source so as to minimize the cost function. When it is determined at step 1905 that the last microphone array is not processed according to j, the program proceeds to step 1906 for calculating sound source direction-orientation cost Ctmp. At step 1906, the program calculates sound source direction-orientation cost Ctmp defined by equation 26.

[Equation 26]

$$C_{tmp} = \min_{x} f(X, g(\theta_i, X_i)) + f(X, g(\theta_j, X_j)) - \beta\lambda(|X - X_i|)Ent_i - \beta\lambda(|X - X_j|)Ent_j \quad \text{(Equation 26)}$$

In the equation, X for Ctmp denotes the global coordinate for the sound source. θi denotes the sound source direction of the sound source in a local coordinate for the ith microphone array. θj denotes the sound source direction of the sound source in a local coordinate for the jth microphone array. Function g is used to convert the sound source direction of the sound source in a local coordinate system for the microphone array into one straight line in the global coordinate system using information on the center coordinate of the microphone array. Function f is used to find the minimum distance between a point and the straight line. Function λ is proportional to the first argument. This function corrects the increasing variation of sound source directions due to an effect of reverberation according as the distance between the microphone array and the sound source increases. Possible functions of λ include λ(x)=x and λ(x)=√x. At step 1907, the program determines whether the calculated cost Ctmp is smaller than the minimum cost Cmin. When the calculated cost Ctmp is smaller than the minimum cost Cmin, the program replaces Cmin with Ctmp and rewrites indexes imin and jmin of the microphone array for estimating the sound source direction and the sound source orientation. At step 1903, the program updates the variables and proceeds to processing of the next microphone array. The program outputs the sound source direction that is calculated for the microphone array so as to minimize the cost. The sound source orientation is assumed to be equivalent to the direction of the microphone array having imin or jmin whichever indicates a larger entropy normalized with λ(x).

Second Embodiment

The second embodiment relates to a video conferencing system that uses the sound source orientation detection block and multiple display devices.

Figure 22:
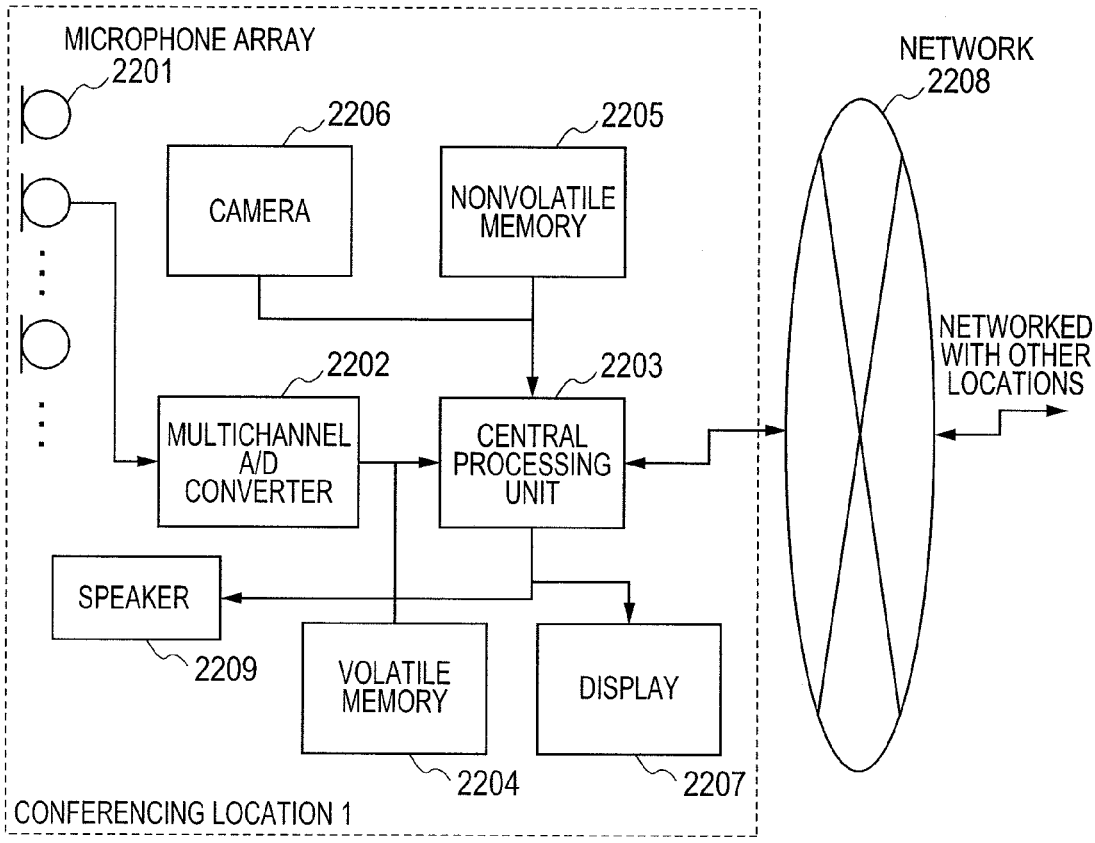
FIG. 22 exemplifies a hardware configuration of the sound source orientation detection block according to the second embodiment used for the video conferencing system.

FIG. 22 shows a hardware configuration of the video conferencing system according to the embodiment. A microphone array 2201 including multiple microphones is installed at each conferencing location. The microphone array 2201 receives a speech signal. A multichannel A/D converter 2202 converts the analog speech signal into a digital signal. The converted digital signal is transmitted to a central processing unit 2203. The central processing unit 2203 extracts only an utterer's speech at the conferencing location from the digital signal. A speaker 2209 reproduces a speech waveform transmitted as a digital signal from a remote conferencing location via a network 2208. The microphone array 2201 receives the reproduced sound. When extracting only an utterer's speech, the central processing unit 2203 removes a sound component reproduced from the speaker using the acoustic echo canceller technology. The central processing unit 2203 extracts information such as the sound source direction and the sound source orientation from the utterer's speech and changes the sound at the remote location reproduced from the speaker. A camera 2206 captures image data at the conferencing location. The central processing unit 2203 receives the image data. The image data is transmitted to a remote location and is displayed on a display unit 2207 at the remote location. Non-volatile memory 2205 stores various programs needed for processing on the central processing unit 2203. Volatile memory 2204 ensures work memory needed for program operations.

Figure 20:
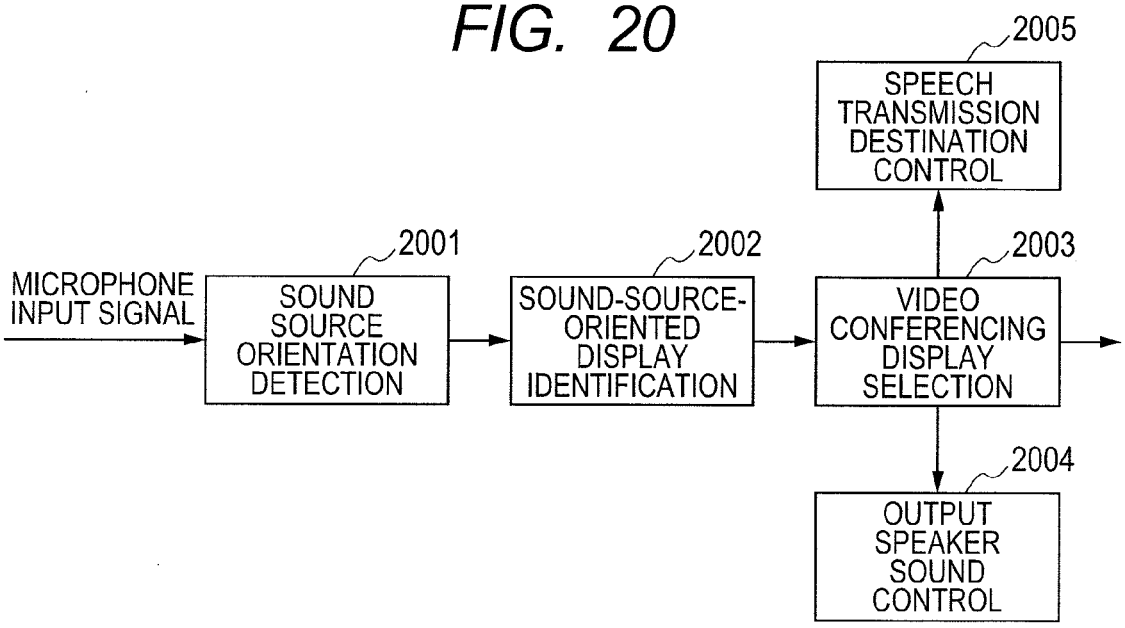
FIG. 20 shows a case of using a sound source orientation detection block according to a second embodiment for a video conferencing system.

FIG. 20 shows the sound source orientation detection block in the central processing unit 2203 according to the embodiment and a processing block of identifying a display oriented to the sound source using a detected orientation result.

A sound source orientation detection block 2001 uses an input signal supplied from the microphone array and detects the sound source orientation shown in FIG. 18. A block of sound-source-oriented display identification 2002 identifies a display available toward the sound source orientation. A block of video conferencing display selection 2003 selects that identified display as an image display that displays an image at the remote location during the video conferencing. This configuration makes it possible to always display the information about the remote location on the display along the direction of the user's utterance.

Based on this information, a block of output speaker sound control 2004 changes the speaker sound so that the speaker reproduces only the speech at the remote location displayed on the display unit along the direction of the user's utterance. The speaker may be controlled so as to loudly reproduce the speech at the remote location displayed on the display unit along the direction of the user's utterance. A block of speech transmission destination control 2005 provides control so that the speech is transmitted to only the remote location displayed on the display unit along the direction of the user's utterance. The transmission may be controlled so that the speech is loudly reproduced at that remote location. Under the above-mentioned control, the video conferencing system linked with multiple locations is capable of smooth conversation with the location where the user speaks.

Figure 23:
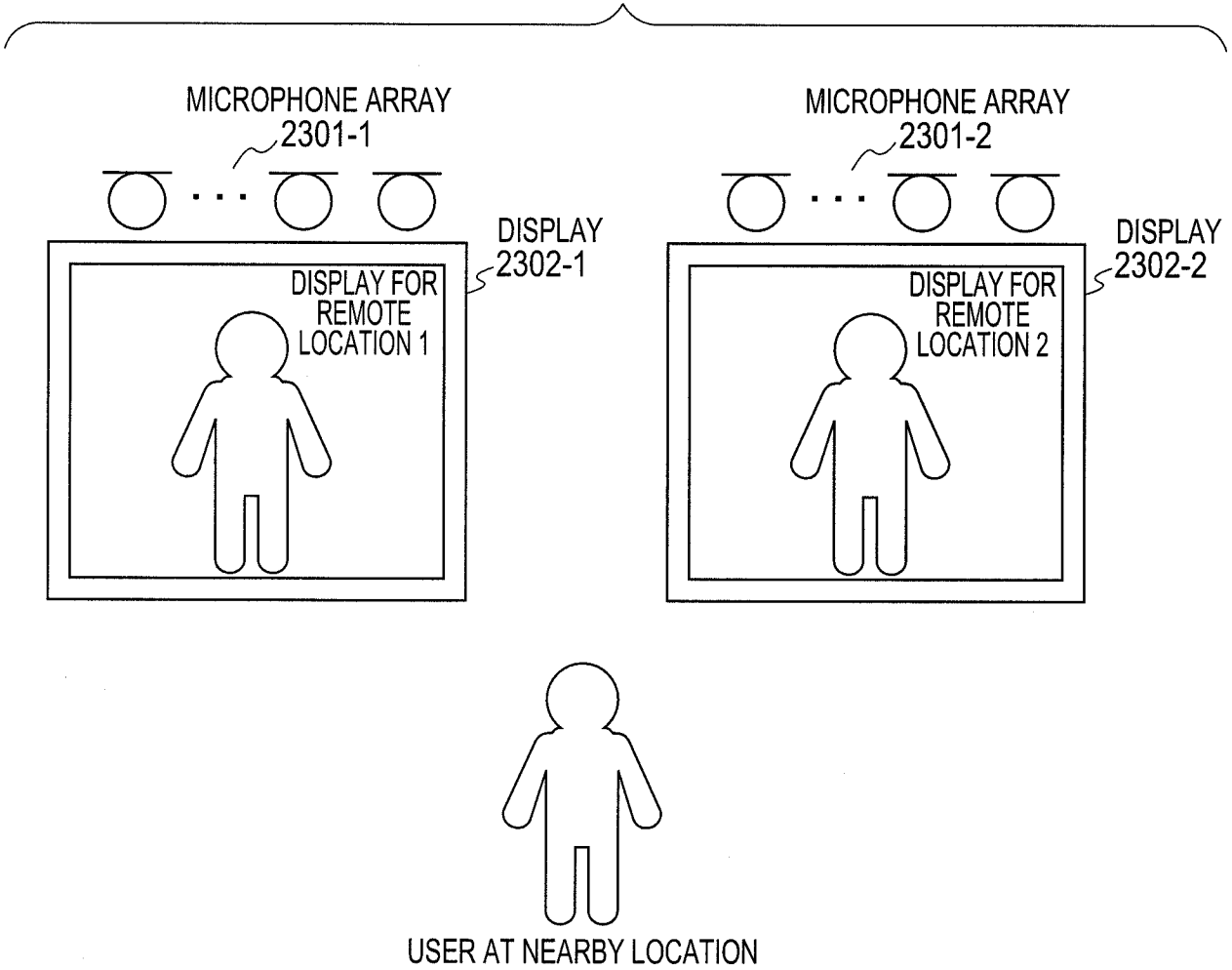
FIG. 23 schematically shows an example of the sound source orientation detection block according to the second embodiment used for the video conferencing system.

FIG. 23 shows an example of the embodiment. In this example, three locations are simultaneously linked with each other and one of the locations is assumed to be a nearby location. At the nearby location, displays 2302-1 and 2302-2 display images that are captured by cameras at remote locations 1 and 2. Microphone arrays 2301-1 and 2301-2 collect speech data from a user at the nearby location. The collected speed data is used to estimate the sound source orientation of that user. For example, let us suppose that the user at the nearby location talks toward the display 2302-1. The speaker loudly reproduces the speech of a user at the remote location 1 displayed on the display 2302-1. In addition, the speech at the nearby location is loudly reproduced at the remote location 1. According to this configuration, the user at the nearby location can more intimately converse with a user at the intended location.

Third Embodiment

Figure 21:
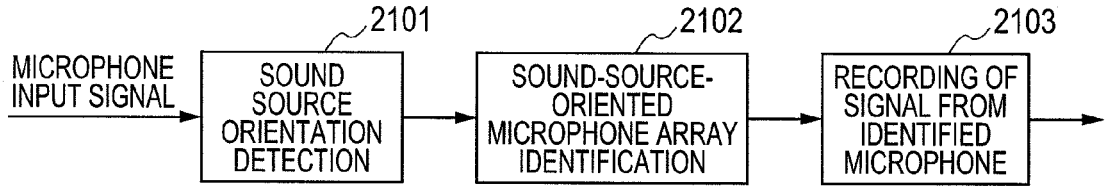
FIG. 21 shows a case of using a sound source orientation detection block according to a third embodiment for conference speech recording.

FIG. 21 relates to the third embodiment and exemplifies a software block configuration of applying the sound source orientation detection block to a sound recording apparatus or a speech collection system. A sound source orientation detection block 2101 detects the sound source orientation as shown in FIG. 18. A block of sound-source-oriented microphone array identification 2102 finds a microphone array toward which the sound source is oriented. A recording apparatus (not shown) records the speech collected by the identified microphone array in a block of recording a signal of the identified microphone 2103. Such configuration enables recording using the microphone array toward which the utterer faces. The speech can be recorded more clearly.

The present invention is useful as a sound monitoring technology or a speech collection technology for acoustically detecting an abnormal apparatus operation in an environment such as a factory where multiple apparatuses operate.

The invention claimed is:

1. A sound monitoring system comprising:

a microphone array having a plurality of microphones;

a processing section;

a storage section; and an A/D converter connected to the microphone;

wherein the storage section stores data concerning the microphone;

wherein the processing section searches for the microphone array near a sound source to be monitored based on data concerning the microphone and selects a sound field monitoring function for the sound source to be monitored based on data concerning the microphone in the searched microphone array;

wherein the data concerning the microphone includes A/D synchronization data on the A/D converter connected to the microphone;

wherein the processing section selects the sound field monitoring function based on the A/D synchronization data;

wherein the data concerning the microphone is stored in the storage section and includes directivity data on the microphone;

wherein the processing section selects the sound field monitoring function based on the directivity data when the A/D synchronization data for the searched microphone array indicates synchronization;

wherein the data concerning the microphone includes interval distance for the microphone; and wherein the processing section selects the sound field monitoring function based on the interval distance when the directivity data for the searched microphone array is identified to be omnidirectional.

2. The sound monitoring system according to claim 1, wherein the data concerning the microphone includes layout data on the microphone array; and wherein the processing section searches for the microphone array based on the layout data.

3. The sound monitoring system according to claim 1, wherein the processing section selects the sound field monitoring function having a direction estimation function based on a phase difference when the interval distance for the searched microphone array is smaller than or equal to a specified value.

4. The sound monitoring system according to claim 1, wherein the processing section selects the sound field monitoring function based on a sound volume ratio between the microphones when the interval distance for the searched microphone array is not smaller than or equal to a specified value.

* * * * *